US010071022B2

(12) United States Patent
Park, IV

(10) Patent No.: US 10,071,022 B2
(45) Date of Patent: Sep. 11, 2018

(54) STORAGE CONTAINERS FOR PHARMACEUTICAL DISPENSER

(71) Applicant: PharmRight Corporation, Charleston, SC (US)

(72) Inventor: William C Park, IV, Charleston, SC (US)

(73) Assignee: PharmRight Corporation, Charleston, SC (US)

( * ) Notice: Subject to any disclaimer, the term of this patent is extended or adjusted under 35 U.S.C. 154(b) by 0 days.

(21) Appl. No.: 15/615,865

(22) Filed: Jun. 7, 2017

(65) Prior Publication Data

US 2017/0333290 A1 Nov. 23, 2017

Related U.S. Application Data

(63) Continuation of application No. 15/369,155, filed on Dec. 5, 2016, now Pat. No. 9,770,391, which is a continuation of application No. 14/501,879, filed on Sep. 30, 2014, now Pat. No. 9,550,619.

(60) Provisional application No. 61/885,352, filed on Oct. 1, 2013.

(51) Int. Cl.

| | |
|---|---|
| ***B65D 83/04*** | (2006.01) |
| ***A61J 7/00*** | (2006.01) |
| ***G07F 17/00*** | (2006.01) |
| ***A61J 7/04*** | (2006.01) |

(52) U.S. Cl.

CPC ..... *A61J 7/0084* (2013.01); *A61J 7/0076* (2013.01); *A61J 7/0481* (2013.01); *B65D 83/0409* (2013.01); *G07F 17/0092* (2013.01)

(58) Field of Classification Search

CPC ... B65D 83/0409; A61J 7/0084; A61J 7/0481; G07F 17/0092

See application file for complete search history.

(56) References Cited

U.S. PATENT DOCUMENTS

| | | | |
|---|---|---|---|
| 3,722,740 | A | 3/1973 | List |
| 4,024,984 | A | 5/1977 | Gyimothy et al. |
| 4,223,801 | A | 9/1980 | Carlson |
| 4,573,606 | A | 3/1986 | Lewis et al. |
| 4,903,861 | A | 2/1990 | Yuyama |
| 5,219,095 | A | 6/1993 | Shimizu et al. |
| 5,259,532 | A | 11/1993 | Schwarzli |
| 5,323,929 | A | 6/1994 | Marlar |
| 5,337,919 | A | 8/1994 | Spaulding et al. |
| 5,667,096 | A | 9/1997 | Wu |
| 5,765,606 | A | 6/1998 | Takemasa et al. |
| 5,803,309 | A | 9/1998 | Yuyama et al. |
| 5,865,342 | A | 2/1999 | Ito et al. |

(Continued)

OTHER PUBLICATIONS

"Daniel Island Resident Designs Innovative Solution for Managing Meds," The Daniel Island News, Dec. 19-Dec. 25, 2013, pp. 16-17.

*Primary Examiner* — Patrick Hewey Mackey

(74) *Attorney, Agent, or Firm* — Thrive IP®; Jeremy M. Stipkala

(57) ABSTRACT

Devices dispense medicine and dietary supplements in solid dosage form. The dimensions of the selection slots for the solid dosage forms in a device can be customized in depth by adding or subtracting spacers, and in width by adding or subtracting thickness inserts, or otherwise by employing components of suitable dimensions. Also, structures and methods for resolving jams of solid dosage forms are disclosed.

12 Claims, 33 Drawing Sheets

(56) References Cited

U.S. PATENT DOCUMENTS

| | | | | |
|---|---|---|---|---|
| 5,897,024 | A | 4/1999 | Coughlin et al. | |
| 6,073,799 | A | 6/2000 | Yuyama et al. | |
| 6,085,938 | A | 7/2000 | Coughlin | |
| 6,145,697 | A | 11/2000 | Gudish | |
| 6,343,711 | B1 | 2/2002 | Coughlin | |
| 6,431,399 | B2 | 8/2002 | Gabel et al. | |
| 6,497,342 | B2 * | 12/2002 | Zhang | B65B 35/08 221/121 |
| 6,659,304 | B2 | 12/2003 | Geltser et al. | |
| 6,799,413 | B2 | 10/2004 | Aylward | |
| 7,014,063 | B2 * | 3/2006 | Shows | G06F 19/3462 221/211 |
| 7,080,755 | B2 | 7/2006 | Handfield et al. | |
| 7,100,792 | B2 | 9/2006 | Hunter et al. | |
| 7,249,688 | B2 | 7/2007 | Hunter et al. | |
| 7,255,247 | B2 | 8/2007 | Aylward | |
| 7,359,765 | B2 | 4/2008 | Varvarelis et al. | |
| 7,510,099 | B2 | 3/2009 | Knoth et al. | |
| 7,588,167 | B2 | 9/2009 | Hunter et al. | |
| 7,669,733 | B2 | 3/2010 | Kim | |
| 7,735,683 | B2 | 6/2010 | Handfield et al. | |
| 7,747,345 | B2 | 6/2010 | Ohmura et al. | |
| 7,747,347 | B2 | 6/2010 | Park, IV | |
| 7,789,267 | B2 | 9/2010 | Hutchinson et al. | |
| 7,831,334 | B2 | 11/2010 | Vollm et al. | |
| 7,952,315 | B2 | 5/2011 | Park, IV | |
| 7,988,017 | B2 | 8/2011 | Kulberg et al. | |
| 7,991,507 | B2 | 8/2011 | Liff et al. | |
| 8,066,150 | B2 | 11/2011 | Clarke et al. | |
| 8,113,849 | B2 | 2/2012 | Park, IV | |
| 8,146,331 | B2 | 4/2012 | Soloman | |
| 8,234,838 | B2 * | 8/2012 | Yasunaga | A61J 7/0084 221/123 |
| 8,240,506 | B2 | 8/2012 | Kulberg et al. | |
| 8,272,534 | B2 | 9/2012 | Clarke et al. | |
| 8,386,073 | B2 | 2/2013 | Kim | |
| 8,387,343 | B2 | 3/2013 | Yasunaga et al. | |
| 8,393,495 | B2 | 3/2013 | Kim | |
| 8,887,603 | B2 | 11/2014 | Yuyama et al. | |
| 9,550,619 | B2 * | 1/2017 | Park, IV | B65D 83/0409 |
| 9,770,391 | B2 * | 9/2017 | Park, IV | A61J 7/0084 |
| 2004/0188456 | A1 | 9/2004 | Arai et al. | |
| 2007/0145066 | A1 | 6/2007 | Knoth et al. | |
| 2008/0099499 | A1 * | 5/2008 | Kim | G07F 11/54 221/82 |
| 2013/0256331 | A1 * | 10/2013 | Giraud | B65D 83/0409 221/1 |
| 2015/0090733 | A1 | 4/2015 | Park | |
| 2017/0079884 | A1 | 3/2017 | Park | |

* cited by examiner

STORAGE CONTAINERS FOR PHARMACEUTICAL DISPENSER

RELATED APPLICATIONS

This application is a continuation of, and claims benefit under 35 U.S.C. § 120 of U.S. Non-Provisional patent application Ser. No. 15/369,155, filed on Dec. 5, 2016, and entitled, "SLOT ADJUSTMENT AND JAM CLEARANCE FOR PHARMACEUTICAL DISPENSER," allowed, which is a continuation of and claims benefit under 35 U.S.C. § 120 of U.S. Non-Provisional patent application Ser. No. 14/501,879, filed on Sep. 30, 2014, and entitled, "SLOT ADJUSTMENT AND JAM CLEARANCE FOR PHARMACEUTICAL DISPENSER," now U.S. Pat. No. 9,550,619 B2, which claims benefit under 35 U.S.C. § 119(e) of U.S. Provisional Patent Application No. 61/885,352, filed on Oct. 1, 2013, entitled, "DEVICE FOR DISPENSING PHARMACEUTICAL DOSES;" the foregoing non-provisional and provisional patent applications and patent are incorporated herein by reference in their entirety.

FIELD OF INVENTION

This invention relates to automated or on-demand dispensing of medicine, such as for an individual patient.

BACKGROUND OF THE INVENTION

Many patients these days take more than one medicine or dietary supplement. Each medicine or dietary supplement may have its own rules for consumption, such as, for example, the frequency, the time of day, and the accompanying food or beverage (or absence thereof). For some patients, managing even one once-daily medicine can be challenging: it is possible to forget whether the daily dose has been consumed. When a patient must manage more than one medicine, each with its own rules for consumption, the likelihood for confusion, missed doses, overdose, and general noncompliance by the patient increases. Those problems at best reduce the efficacy of the medicine, and at worst, place the patient at significant risk for untreated illness and drug-related injury.

Medicine-dispensing devices have been proposed before. Solid dosage forms such as pills, however, can jam inside the dispensing device. If the jam is not resolved properly, the jammed pills can be damaged by the device, such as by chipping or crushing the pills. Worse, the device can be damaged as it continues to operate, applying force against jammed pills. The device may also become contaminated with residue from damaged pills. Most importantly, the patient may receive less medicine by consuming a damaged pill, or no medicine at all, if the jam prevents any pill from being dispensed.

Previous medicine-dispensing devices have made it difficult or impossible to adjust the dimensions of the device to accommodate different medicines and nutraceuticals. Pills, tablets, capsules, and gel capsules may have different physical dimensions, yet most devices have used a one-size-fits-all approach to separating one solid dosage form from a plurality of stored solid dosage forms. That means an entire device is limited to a single size and shape of solid dosage form, or the device attempts to handle diverse solid dosage forms. Such devices may be unsatisfactory for a given patient's medicine and dietary supplement regimen, because they cannot handle all of the solid dosage forms required by the regimen.

SUMMARY OF THE INVENTION

In some embodiments, Applicant has invented devices that allow a patient and caregivers to better manage the patient's medicine and dietary supplement regimen. In other embodiments, devices are designed to resist jamming by solid dosage forms. Still other embodiments provide methods for resolving a jam in a device for dispensing solid dosage forms. Additional embodiments provide methods for dispensing a single solid dosage form. Still additional embodiments provide methods for dispensing two or more different solid dosage forms. Further embodiments allow for customizing the dimensions of a device for separating a single solid dosage form from a plurality of stored solid dosage forms.

Some embodiments solve the technical problem of reducing the tendency of solid dosage forms from jamming when separating one solid dosage form from a plurality of solid dosage forms. Other embodiments solve the technical problem of customizing the dimensions of the device that separates a solid dosage form to match the dimensions of the solid dosage form. In certain cases, that customization is easy, reversible, and can be performed after the device is manufactured. Still other embodiments solve the technical problem of providing a device having several storage compartments for diverse solid dosage forms, wherein each storage compartment is coupled to a separation mechanism that can be customized to match the dimensions of the diverse solid dosage forms. In certain cases, that customization is easy, reversible, and can be performed after the device is manufactured.

Thus, certain instances of the present invention provide devices for dispensing a solid dosage form, comprising: a storage compartment comprising a volume for storing a plurality of solid dosage forms having a same shape; and a receiver coupled to the storage compartment and adapted to rotate about an axis, comprising a selection slot at a distance from the axis, wherein the selection slot is adapted to separate a single solid dosage form from the plurality of solid dosage forms when the receiver is selectively rotated clockwise and counterclockwise about the axis, and wherein the receiver is adapted to reversibly couple to at least one spacer to accommodate the same shape in the selection slot.

Other instances of the present invention provide devices for selectively dispensing two or more unique solid dosage forms from a collection of unique solid dosage forms, wherein a unique solid dosage form in the collection has a shape that is independently alike or different from other unique solid dosage forms in the collection, wherein the device comprises:

a storage compartment for each unique solid dosage form, comprising a volume for storing a plurality of the unique solid dosage form separately from other unique solid dosage forms, and a receiver coupled to the storage compartment for each unique solid dosage form, the receiver adapted to rotate about an axis, and comprising a selection slot at a distance from the axis, wherein the selection slot is adapted to separate a single unique solid dosage form from the plurality stored in the storage compartment when the receiver is selectively rotated clockwise and counterclockwise about the axis, and wherein the receiver is adapted to reversibly couple to at least one spacer to accommodate the shape of the unique solid dosage form in the selection slot.

Further instances of the present invention relate to methods of dispensing a single solid dosage form, comprising:

(a) obtaining a device that comprises a storage compartment storing a plurality of solid dosage forms having a same shape; and a receiver coupled to the storage compartment and adapted to rotate about an axis, comprising a selection slot at a distance from the axis, wherein the receiver is adapted to reversibly couple to at least one spacer to accommodate the same shape in the selection slot;

(b) rotating in a first direction the receiver about the axis;

(c) determining that the selection slot has not separated the single solid dosage form from the plurality;

(d) rotating in a second direction the receiver about the axis;

(e) optionally repeating one or more of the (b) rotating in a first direction, the (c) determining, and the (d) rotating in a second direction; and (f) detecting that the selection slot has separated the single solid dosage form from the plurality;

(g) dispensing the single solid dosage form from the device; thereby dispensing the single solid dosage form.

Certain additional instances relate to methods of resolving a jam in a device for dispensing a solid dosage form, wherein the device comprises a storage compartment storing a plurality of solid dosage forms having a same shape; and a receiver coupled to the storage compartment and adapted to rotate about an axis, comprising a selection slot at a distance from the axis, wherein the receiver is adapted to reversibly couple to at least one spacer to accommodate the same shape in the selection slot; the method comprising:

(a) rotating in a first direction about 90 degrees the receiver;

(b) determining that a jam of the solid dosage forms exist;

(c) rotating in a second direction about 45 degrees the receiver;

(d) detecting that the selection slot has separated a single solid dosage form from the plurality;

thereby resolving the jam.

Yet additional instances of the present invention relate to methods for dispensing two or more unique solid dosage forms from a collection of unique solid dosage forms, wherein a unique solid dosage form in the collection has a shape that is independently alike or different from other unique solid dosage forms in the collection, wherein the method comprises:

(a) obtaining a device that comprises storage compartments, each storage compartment storing a plurality of a unique solid dosage form separately from other unique solid dosage forms in the collection, and comprising a receiver coupled to the storage compartment, adapted to rotate about an axis, comprising a selection slot at a distance from the axis, wherein the receiver is adapted to reversibly couple to at least one spacer to accommodate in the selection slot the shape of the unique solid dosage form stored in the storage compartment;

(b) selecting the two or more unique solid dosage forms from the collection to dispense, thereby identifying selected forms;

(c) for at least one of the storage compartments storing the selected forms, (i) rotating in a first direction the receiver about the axis;

(ii) determining that the selection slot has not separated a single selected form from the plurality;

(iii) rotating in a second direction the receiver about the axis;

(iv) optionally repeating one or more of the (i) rotating in a first direction, the (ii) determining, and the (iii) rotating in a second direction; and (v) detecting that the selection slot has separated the single selected form from the plurality;

(d) for at least one other of the storage compartments storing the selected forms, (i) rotating in a third direction the receiver about the axis, wherein the third direction is independently alike or different from the first direction;

(ii) detecting that the selection slot has separated the single selected form from the plurality;

(e) repeating (c) and (d) until all selected forms have been separated;

(f) dispensing all selected forms that have been separated; thereby dispensing the two or ore unique solid dosage forms.

Those and other instances and embodiments will be described in greater detail below.

DETAILED DESCRIPTION

Figure 1:
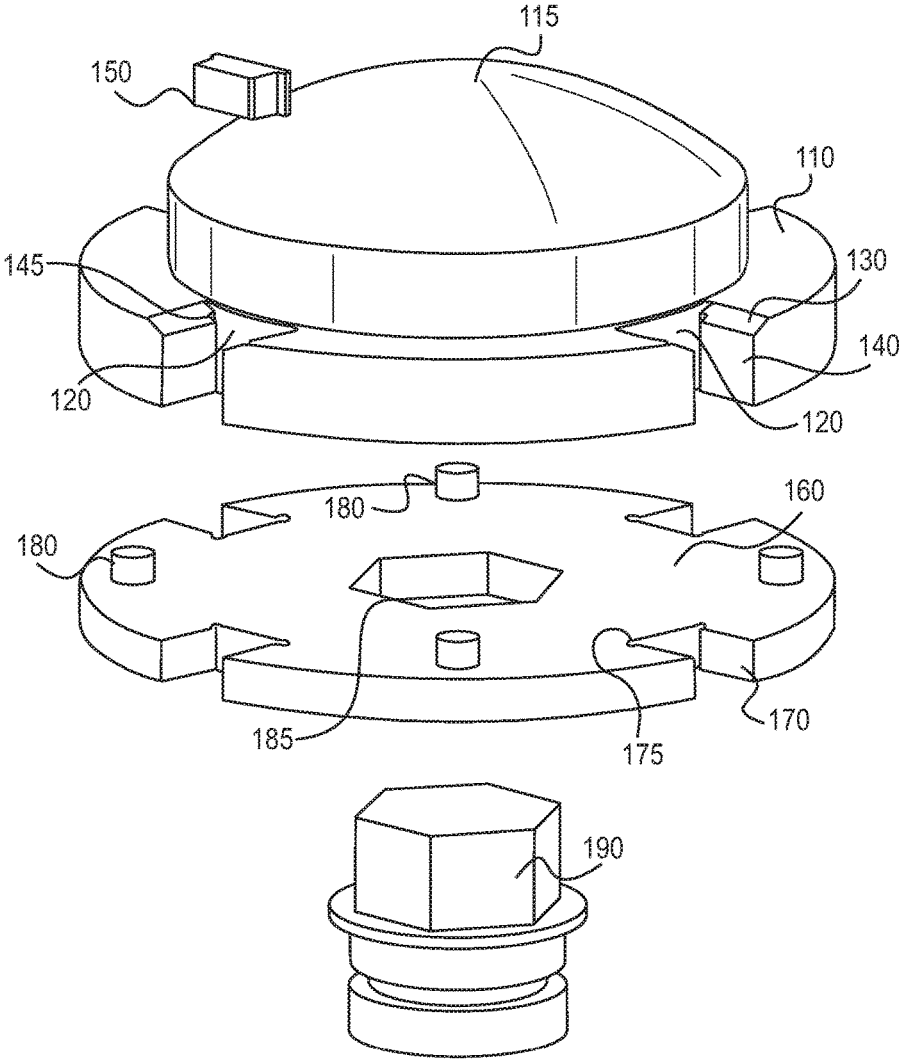
FIG. 1 depicts a perspective view of one embodiment of the invention comprising a receiver. The receiver and related parts appear in "exploded" format.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

DEFINITIONS

Solid Dosage Form—any discrete solid unit of medicine or dietary supplement, such as, for example, a pill, tablet, capsule, or gel capsule. A solid dosage form can contain a single substance, a single substance with one or more inactive ingredients, or more than one substance optionally with any suitable inactive ingredients. For example, a pill can contain just one vitamin, or it can contain a combination of vitamins, minerals, and extracts, such as a multivitamin capsule designed for once-daily consumption. So-called inactive ingredients are not limited, and can include any suitable substance not primarily intended as a medicine or dietary supplement, such as, for example, fillers, colors, solubilizers, dissolving aids, and the like, and combinations thereof. Solid dosage forms include those capsules that contain a liquid, such as, for example, oil-soluble vitamins and fish oil dietary supplements.

Pharmaceutical—relating to medicine, whether prescription, over-the-counter, or a combination thereof. Any medicine that is or can be included in a solid dosage form may be used in certain embodiments of the present invention. When used herein as a noun, "pharmaceutical" refers to a medicine.

Nutraceutical—relating to dietary supplements, such as vitamins, minerals, and herbal, animal, fruit, and vegetable extracts. A nutraceutical solid dosage form can include any suitable dietary supplement or combinations thereof, in any suitable amount. It can be appreciated that the line between "pharmaceutical" and "nutraceutical" can be blurry for some substances; for the purposes of the present disclosure, what matters most is that the patient desires to or is directed to consume the substance regularly, and the substance appears in a solid dosage form. When used herein as a noun, "nutraceutical" refers to a dietary supplement.

Shape, as in Same Shape—the characteristic physical dimensions of a given solid dosage form of a particular pharmaceutical or nutraceutical. As can be appreciated by the skilled artisan, solid dosage forms of medicines come in a wide variety of shapes and sizes. Certain embodiments of the present invention allow for nearly any solid dosage form to be dispensed from a storage compartment by a receiver. Each solid dosage form has a unique length, width, and height, or other physical dimensions such as radius, thickness, and profile (for example, a circular pill that is thicker in the center of the pill than at the edge), or length and maximum thickness (for example, a football-shaped or ellipsoidal pill or gel capsule).

Reversibly Couple—to connect durably but not permanently. A receiver in some embodiments of the present invention is adapted to connect to one or more spacers. The connection can be any suitable connection, such as, for example, "snap together," or by a fastener such as one or more clips, bolts, screws, or combinations thereof. So that the receiver can be used with a solid dosage form of differing dimensions, the spacer can be uncoupled from the receiver to accommodate spacers of different dimensions.

Receiver—a component for separating a single solid dosage form from a plurality of solid dosage forms, all having the same shape. A receiver will have at least one selection slot sized appropriately to cause a single solid dosage form to enter the selection slot when the receiver is rotated. The receiver can be made of a single piece of material, or it can be made of several pieces of material reversibly coupled and/or permanently coupled.

Spacer—a component for lengthening the selection slot of a receiver a distance equal to the thickness of the spacer. For example, a receiver can provide a selection slot that is 8 mm wide in the radial direction, 8 mm wide in the circumferential direction, and 8 mm deep in the vertical direction, relative to the rotational axis of the receiver. A spacer that is 4 mm thick and has a slot that is 8 mm×8 mm can be coupled to the receiver to extend the depth of the selection slot to 8 mm in the vertical direction.

Thickness Insert—a component for reducing the width of the selection slot of the receiver a distance equal to the thickness of the thickness insert.

Sweeper—a component for aiding the selection slot to separate a single solid dosage form from a plurality of solid dosage forms. In some cases, a sweeper acts analogously to a cow catcher on a train locomotive: as the receiver rotates, a selection slot passes under a sweeper, set a selected distance above the selection slot. The sweeper prevents any more than one solid dosage form from approaching the selection slot, lessening the likelihood of jams in certain instances.

Fluid Contact—two points are in fluid contact if the fluid such as air or gas about one of the points can circulate, flow, or diffuse to the fluid about the second point. For example, a desiccant can be placed in fluid contact with the air surrounding a plurality of pills within a storage compartment. Any humidity in the air would be wicked out of the air, thereby protecting the pills from damage by the humidity.

DETAILED EMBODIMENTS

Some embodiments of the present invention provide a device wherein the receiver is adapted to reversibly couple to at least one thickness insert to accommodate the same shape in the selection slot. One or more thickness inserts can be placed in the selection slot to reduce one or more dimensions of the selection slot. For example, a single thickness insert can reduce the width of the slot in a radial direction, that is, with reference to the axis of the receiver. In another example, a pair of thickness inserts can reduce the width of the slot in a circumferential direction, that is, with reference to the edge of the receiver. Accordingly, in still other cases, the selection slot is adapted to reversibly couple to the at least one thickness insert, thereby reducing a dimension of the selection slot.

The receiver can be any suitable shape. Specific embodiments provide a receiver that is substantially circular. A circular receiver, in those embodiments, allows the plurality of solid dosage forms to approach the selection slot while preventing those forms from blocking the receiver from rotating. In other embodiments, the shape of the storage compartment, the presence of sweepers or other structure, or combinations thereof direct solid dosage forms toward the selection slot and away from other mechanisms to avoid interfering with operation of the device. In some embodiments, a receiver comprises at least two pieces: first, a selection slot selector, and second, a selection slot carrier. The selection slot selector reversibly couples to the selection slot carrier so that a particular selection slot is exposed to the plurality of solid dosage forms. The selection slot carrier includes selection slots of varying dimensions, so the same receiver can be adapted to work with a variety of solid dosage forms. See FIGS. 22-23 for examples of these embodiments.

The selection slot is located in any suitable portion of the receiver, so that the receiver can separate a single solid dosage form for dispensing. In some cases, the selection slot is located at an edge of the receiver. In other cases, the selection slot is located inward from an edge of the receiver.

In further cases, the selection slot comprises a guiding portion adapted to introduce the single solid dosage form into the selection slot, and a transporting portion adapted to move the single solid dosage form away from the plurality of solid dosage forms. A guiding portion can comprise a gradual or sloping surface that allows a pill or other solid dosage form to fall into the selection slot, when gravity is employed in the design of the receiver to separate the solid dosage form. Then, the transporting portion has a length suitable to cause one and only one solid dosage form to enter the selection slot. The length of the transporting portion can be less than the length of the solid dosage form, so that the length of the entire selection slot, defined by the thickness of the receiver and the thickness of any spacers coupled to the receiver, is the same as the length of the solid dosage form. As the receiver is rotated, the solid dosage form reaches an exit port in the storage compartment underneath the receiver and any spacers coupled to the receiver, and the solid dosage form drops out of the storage compartment to be dispensed. Accordingly, additional cases provide a receiver that is adapted to reversibly couple to the at least one spacer in a manner that lengthens a dimension of the selection slot, namely, its length.

Any suitable structure or structures can be used to direct the solid dosage forms toward a selection slot in the receiver. For example, in some embodiments, the receiver further defines a convex surface adapted to direct solid dosage forms from the plurality toward the selection slot.

Another embodiment provides a receiver having more than one selection slot. Thus, a receiver may have one, two, three, four, five, six, seven, eight, or more than eight selection slots. The selection slots can be the same or different dimensions. In some cases, a receiver comprises a selection slot selector reversibly coupled to a selection slot carrier having selection slots of different dimensions. The selection slot selector is coupled to the selection slot carrier so that selection slot(s) of the same dimension are exposed to the plurality of solid dosage forms. In certain instances, a selection slot carrier includes selection slots each having different dimensions. In other instances a selection slot carrier includes more than one selection slot having the same dimensions. The selection slot selector in those instances would have more than one opening, so that when the selection slot selector is coupled to the selection slot carrier, those openings expose those selection slots having the same dimensions to the plurality of solid dosage forms. Optionally, a selection slot is coupled to a detector to determine whether the slot contains a solid dosage form. When it is time to dispense a solid dosage form, the receiver can be instructed to place an occupied selection slot proximate to an exit port in the storage compartment, thereby dispensing a solid dosage form.

Any suitable structure or structures can be used to separate a single solid dosage form from the plurality. Optionally, that structure or structures also reduce the tendency for the solid dosage forms to jam. Accordingly, certain embodiments provide a device having a sweeper coupled to the storage compartment and adjustably positioned proximate to the selection slot of the receiver to aid the selection slot to separate the single solid dosage form when the receiver is selectively rotated. In some cases, a sweeper can be coupled to a convex adapter. A convex adapter can be designed to augment the receiver by directing solid dosage forms toward the selection slot. When more than one storage compartment is present, one or more of the storage compartments can have a sweeper. Each sweeper is positioned to aid the selection slot for separating the solid dosage form stored in that compartment. In another example, a sweeper can be coupled to a sweeper shaft supporting a thumb tab that allows an operator to position the sweeper in the storage compartment proximate to the receiver.

Certain embodiments of the present invention allow for a receiver and appropriate spacer(s) to be molded of a single piece of material such as thermoplastic. If it is contemplated that a unique solid dosage form will be used with a particular receiver-spacer assembly or even in a particular storage compartment, it is possible to design a receiver-spacer assembly having one or more selection slots each having the dimensions suitable for that unique solid dosage form. That way, for example, a pharmaceutical company can package its product in storage compartments having receiver-spacer assemblies ready to separate a single solid dosage form from a plurality of solid dosage forms packaged in those storage compartments.

Since the storage compartment is expected to hold more than one solid dosage form, it can be advantageous in some cases to provide a desiccant to dry out the air inside the storage compartment. Thus, additional embodiments provide a storage compartment having a desiccant in fluid contact with the plurality of solid dosage forms. Any suitable desiccant can be used, such as, for example, silica, molecular sieves, activated charcoal, calcium sulfate, calcium chloride, and non-reactive combinations thereof. In certain instances, the desiccant is contained to minimize contamination or chemical reaction with the contained plurality of solid dosage forms.

Some embodiments provide a detector to detect when the selection slot has separated a single solid dosage form from the plurality of solid dosage forms. Other embodiments provide a detector to detect when a device has dispensed a solid dosage form from a point common to all storage compartments in the device. Any suitable detector can be used. Certain devices may have the same or different detectors. Suitable detectors include, but are not limited to, an electromechanical switch, a laser diode, a fiberoptic array, a photoanode, or a combination of two or more thereof. The detector can be associated with the device in any suitable manner. In some cases, the detector determines whether the selection slot contains a solid dosage form. In other cases, the detector determines whether a solid dosage form has exited the selection slot through an exit port in the storage compartment. Further cases provide a detector associated with the selection slot, and another detector associated with the exit port. Still other cases provide a single detector centrally located, such as, for example, below a collection funnel where all dispensed medicine must pass. If no solid dosage form passes the detector, then a jam may exist. In such a situation, the jam in that storage compartment should be resolved before solid dosage forms from other storage compartments are dispensed. If the jam cannot be resolved, the dispensing device should dispense what solid dosage forms it can, alert the user of the situation, and indicate which solid dosage forms are dispensed and which are not.

Any suitable method for resolving a jam can be employed with the devices of the present invention. In addition to the methods described above, some embodiments provide methods that include, after the (c) rotating in a second direction, (c.1) determining that the jam still exists;

(c.2) repeating for a first predetermined number of attempts the (a) rotating in a first direction, the (b) determining, and the (c) rotating in a second direction.

Other embodiments provide, after the (c.2) repeating, (c.3) determining that the jam still exists;

(c.4) rotating in the second direction about 90 degrees the receiver;

(c.5) determining that the jam still exists; and (c.6) rotating in the first direction about 45 degrees the receiver.

Still other embodiments provide, after the (c.6) rotating in the first direction, (c.7) determining that the jam still exists;

(c.8) repeating for a second predetermined number of attempts the (c.4) rotating in the second direction, the (c.5) determining, and the (c.6) rotating in the first direction.

The direction of rotation of the receiver is not limited. When the receiver is viewed, for example, from a given direction along its axis of rotation, in some cases, the first direction is clockwise, and the second direction is counterclockwise. In other cases, the first direction is counterclockwise, and the second direction is clockwise.

The number of predetermined attempts is also not limited. One, two, three, four, or more attempts can be made in a first direction, and then one, two, three, four, or more attempts can be made in a second direction.

Additional embodiments of the present invention allow the patient or the caregiver, or both, to effectively manage the daily, weekly, or monthly pharmaceutical and nutraceutical consumption of a patient. That management can be comprehensive, for example, if the management covers everything the patient consumes other than food and beverage. In other cases, that management can be limited, such as, for example, to the prescription medicines the patent must take, excluding the dietary supplements the patient also consumes. Of course, no matter the scope of the management, care should be taken to account for and avoid the potential for adverse reactions between medicines and dietary supplements. Accordingly, in some embodiments, the collection of unique solid dosage forms represents the weekly pharmaceutical and nutraceutical consumption of a patient. For example, a certain patient consumes five different medicines and one dietary supplement every week. Thus, that patient's collection of medicines and dietary supplements requires six storage compartments. In this example, the first storage compartment would store a plurality of doses of the first medicine, the second storage compartment would store a plurality of doses of the second medicine, and so on, so that all medicines and dietary supplements are stored and available to be dispensed. In other embodiments, the (b) selecting represents a single pharmaceutical and nutraceutical consumption event of a patient. For example, a single consumption event could represent all of the medicine and dietary supplements a patient takes at a particular time of day, such as, for example, "upon waking," "with breakfast," "an hour after breakfast," "in between breakfast and lunch," "with a snack," "with lunch," "in between lunch and dinner," "with dinner," "one hour after dinner," "one hour before bedtime," "at bedtime," "once every X hours" where X is an integer, "Y times a day" where Y is an integer," and "as needed" or "PRN."

Embodiments of the present invention can be made with any suitable materials. Metals, such as steel and aluminum, and plastics, such as high impact polystyrene, polyethylene, polypropylene, and polyamides, may be mentioned, as well as combinations of any two or more thereof. Methods of making the embodiments of the present invention are not limited either. Casting, milling, three-dimensional printing, injection molding, and combinations thereof may be mentioned. Thus, some embodiments of the present invention relate to methods of making a storage compartment as disclosed herein. Other embodiments relate to methods of making a receiver. Still other embodiments relate to methods of making a spacer. Further embodiments relate to methods of making a thickness insert. Yet further embodiments relate to methods of coupling a receiver with at least one spacer to accommodate at least one dimension of a solid dosage form.

Thus, some embodiments provide methods for making a device for dispensing a solid dosage form, the device comprising: a storage compartment comprising a volume for storing a plurality of solid dosage forms having a same shape; and a receiver coupled to the storage compartment and adapted to rotate about an axis, comprising a selection slot at a distance from the axis, wherein the selection slot is adapted to separate a single solid dosage form from the plurality of solid dosage forms when the receiver is selectively rotated clockwise and counterclockwise about the axis, and wherein the receiver is adapted to reversibly couple to at least one spacer to accommodate the same shape in the selection slot, comprising adapting the receiver to couple to the storage compartment. Further methods comprise coupling the receiver to the storage compartment.

Methods of the present invention, such as methods of use, can be executed by any suitable means. For example, a patient or a caregiver can manually select the medicines to be dispensed, and the device dispenses the medicines. In one embodiment, a device includes storage compartments A, B, and C, each storage compartment holding a unique medicine in solid dosage form. The patient or caregiver presses a button labeled "A" and a solid dosage form from storage compartment A is dispensed. Optionally, a processor runs a software program designed to rotate the receiver, detect whether a solid dosage form has been dispensed by the receiver, and, if no solid dosage form is detected, execute a jam-resolving protocol such as one of those described herein. For another example, the entire regimen of medicines and dietary supplements for a patient can be entered into a computer or similar device, and the computer can cause a device of the present invention to dispense the medicines and dietary supplements in accordance with the regimen. Such a computer can be separate from, or integrally part of, a device of the present invention.

The rotation of the receiver can be caused by any suitable means. In some cases, the receiver is mechanically coupled to an electric motor. Suitable motors are not limited. In certain instances, the electric motor is configured to rotate the receiver through an arc about an axis. In certain instances, the motor has a shaft that defines the axis of the receiver. When the motor turns, the receiver turns. Certain embodiments provide a motor electrically or mechanically adapted to rotate a receiver both clockwise and counterclockwise. Electrically, this can be accomplished by reversing the polarity of electrical energy reaching the motor. Mechanically, this can be done by inserting a gear between a drive-shaft of the motor and an axial shaft of the receiver, such as, for example, by coupling the gear to an actuator that selectively inserts and withdraws the gear between the drive shaft and the axial shaft.

In some embodiments, the motor or device comprises a current overload sensor that signals that a jam has developed. When the current drawn by the motor exceeds a pre-selected threshold, the current overload sensor will activate, and the need to turn the receiver in the opposite direction will be indicated. Optionally, the current overload sensor can cause the motor to cease turning in the direction of the increasing current. Or, the current overload sensor can send a signal to a controlling system, and the system can evaluate how to respond to the signal by executing logic. The current threshold can be any suitable threshold. In one instance, the threshold should be low enough to avoid damaging the solid dosage forms. In another instance, the threshold should be high enough so that ordinary loads do not falsely signify a jam.

DETAILED DESCRIPTION OF THE DRAWINGS

Further embodiments of the present invention can be described by reference to the accompanying drawings. Note that "vertical" and "horizontal" and similar terms should not be considered limiting, but are used herein solely to aid the skilled artisan to understand and carry out the claimed invention. Not every component that appears more than once in a given figure has been labeled, for clarity.

FIG. 1 depicts a perspective view of one embodiment of the invention comprising a receiver. The receiver and related parts appear in "exploded" format. Substantially circular receiver (110) has two selection slots (120) visible at its edge, with four selection slots (120) total, and a convex surface (115) for guiding solid dosage forms to the selection slots (120). Each selection slot (120) has a guiding portion (130) adapted to introduce a single solid dosage form (not shown) into the selection slot (120), and then a transporting portion (140) adapted to move the single solid dosage form (not shown) away from a plurality of solid dosage forms (also not shown—see FIG. 5). Each selection slot also has a groove (145) for reversibly coupling a thickness insert (150), which narrows the selection slot (120). The size of the various components can be any suitable dimensions. For example, the guiding portion (130) can be, at its widest point, any suitable dimension relative to the width of the transporting portion (140). In some cases, the guiding portion is twice as wide, in the circumferential direction, than the transporting portion (140). In other cases, the guiding portion (130) is 16 mm at its widest point in the circumferential direction, and the transporting portion (140) is 8 mm in the same direction. In certain instances, the receiver is as thick in the vertical direction as the transporting portion (140) is wide. Thus, in some cases, the receiver (110) is 8 mm in the vertical direction, and the transporting portion (140) is 8 mm in the circumferential direction. In other cases, the receiver is half as thick as the transporting portion (140) is wide. For example, the receiver (110) can be 4 mm in the vertical direction, while the transporting portion (140) is 8 mm in the circumferential direction. In a further case, selection slot (120) is 4 mm in the radial direction, and 8 mm deep in the vertical direction; and the transporting portion (140) is 8 mm in the circumferential direction.

Guiding portion (130) can have any suitable profile. Curved or flat or otherwise, the purpose of guiding portion (130) in some embodiments is to coax solid dosage forms (not shown) into selection slot (120). Flat surfaces of guiding portion (130) can descend from the horizontal at any suitable angle, such as, for example, 30 degrees, 45 degrees, or 60 degrees from the horizontal.

Also shown is a spacer (160) with four slots (170) that would align with, and lengthen, the selection slots (120) of the receiver (110). The slots (170) of the spacer have grooves (175) to accommodate the thickness insert (150). Spacer (160) has spacer pins (180) to allow the spacer (160) to reversibly couple to the receiver (110), and an opening (185) to accommodate an axial shaft (190). The axial shaft (190) would mechanically couple to a motor (not shown) that would selectively rotate the axial shaft (190), and thereby the receiver (110) and the spacer (160), clockwise and counterclockwise to cause a solid dosage form (not shown) to enter selection slot (120) and to resolve jams.

Figure 2:
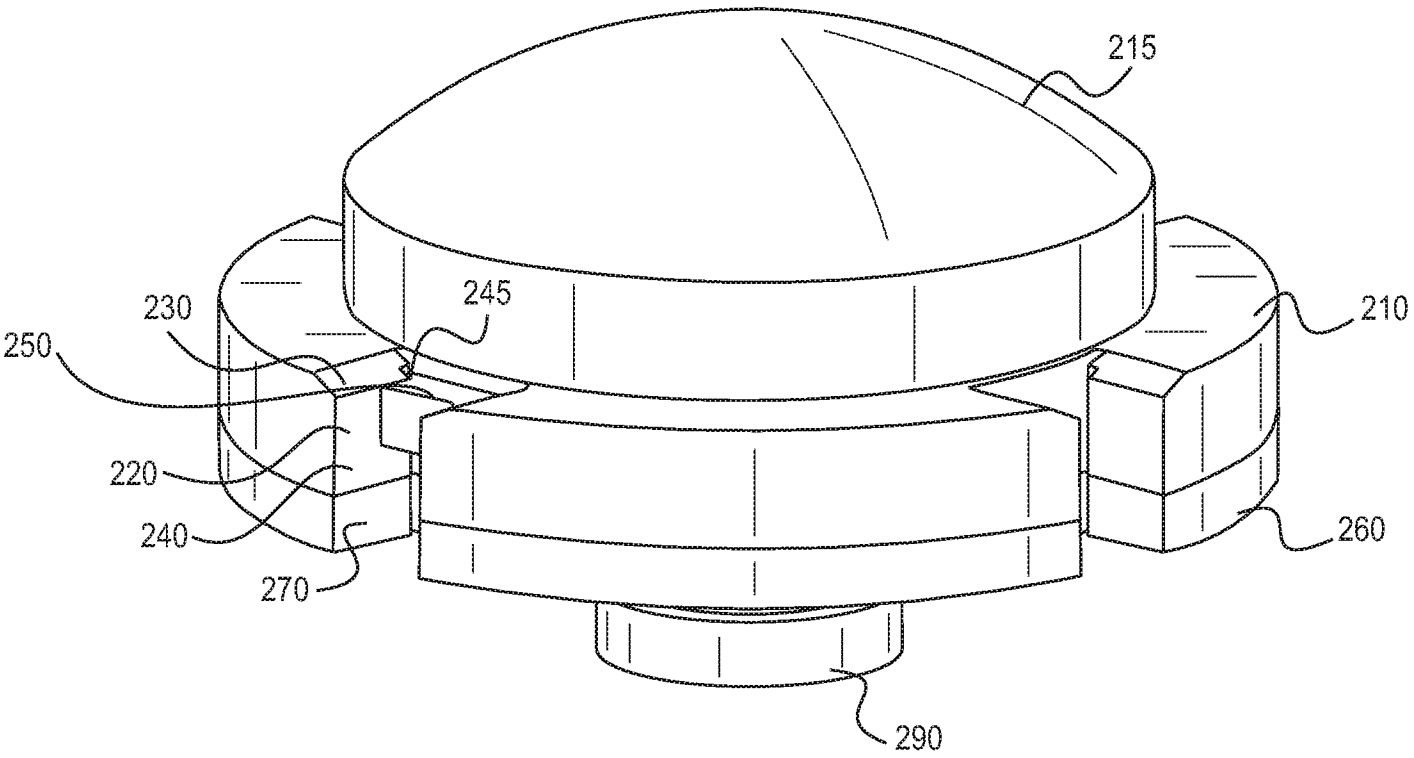
FIG. 2 depicts another perspective view of an embodiment comprising a receiver. The receiver and related parts appear assembled for use.

FIG. 2 depicts another perspective view of the embodiment shown in FIG. 1 comprising a receiver. The receiver and related parts appear assembled for use. Receiver (210) has four selection slots (220), of which two are visible. The receiver (210) has a convex surface (215) and is reversibly coupled to a spacer (260). Receiver (210) and spacer (260) are attached to the axial shaft (290). Thickness insert (250) rests in its groove (245), narrowing the selection slot (220), and is thereby reversibly coupled to the receiver (210). The thickness insert (250) reduces a dimension of the selection slot (220), in this case, the width in the radial direction. Only one thickness insert (250) is shown in this embodiment. In some embodiments, all selection slots (220) have the same-sized thickness insert (250) present in each selection slot (220). Guiding portion (230) and transporting portion (240) are designed to separate a single solid dosage form from a plurality of solid dosage forms (not shown) when the receiver (210) is rotated. Spacer (260) has the same number of slots (270) aligned about its edge to line up with and extend the selection slots (220) of the receiver (210). In this way, the receiver (210) is adapted to reversibly couple with the spacer (260) in a manner that lengthens a dimension of the selection slot (220); in this case, the lengthened dimension is the depth of the selection slot (220). Thickness inserts (250) can be any suitable dimension. A receiver (210) can be provided commercially with a set of thickness inserts (250) and spacers (260), variously with different dimensions, so that a variety of shapes and sizes of solid dosage forms can be accommodated. In some embodiments, thickness insert (250) is 4 mm in the radial direction.

Figure 3:
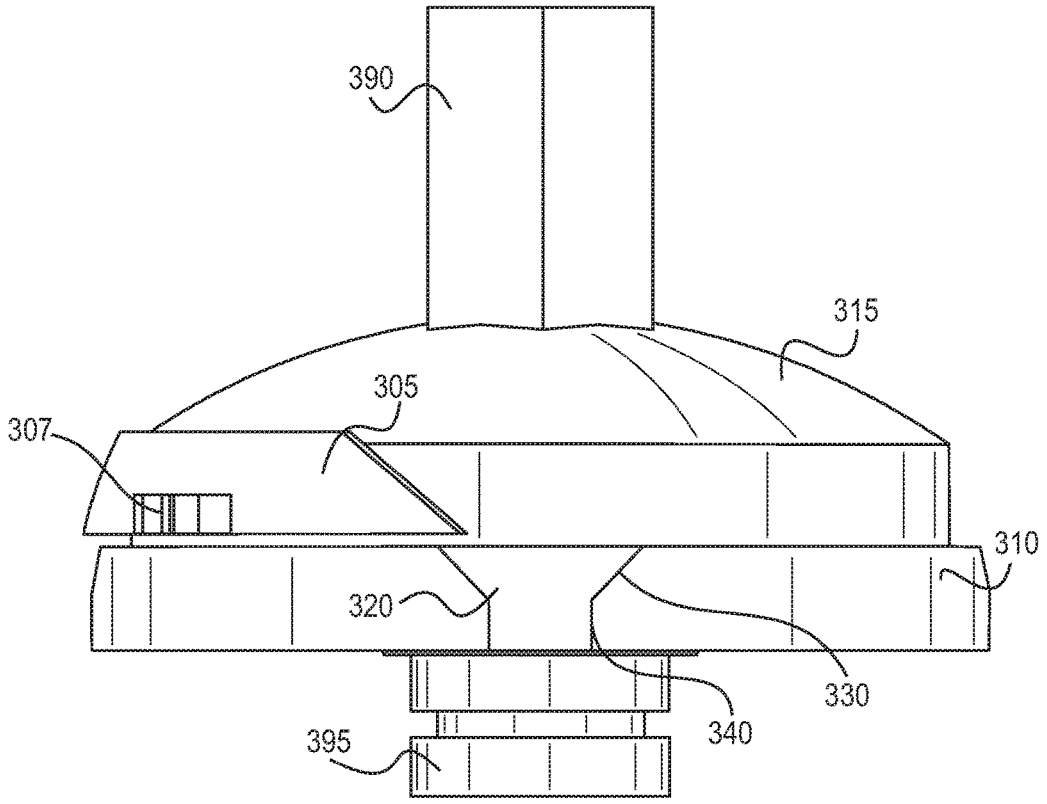
FIG. 3 provides a side view of another embodiment of a receiver, axial shaft, and sweeper.

FIG. 3 provides a side view of another embodiment of a receiver, axial shaft, and sweeper. Substantially circular receiver (310), viewed edge-on, has a convex surface (315) to direct solid dosage forms (not shown) to the selection slot (320), so the receiver (310) can separate a single solid dosage form from a plurality of solid dosage forms (not shown). In this embodiment, axial shaft (390) extends through the center of the receiver (310) and the convex surface (315), and defines an axis about which the receiver (310) will rotate. Selection slot (320), at a distance from the axis, also has guiding portion (330) adapted to introduce a single solid dosage form into the selection slot (320), and transporting portion (340) adapted to move the single solid dosage form (not shown) away from the plurality of solid dosage forms (not shown). Axial shaft (390) has a base (395) adapted to couple to an electric motor (not shown). Also shown in FIG. 3 is a sweeper (305) positioned proximate to the selection slot (320) to aid the selection slot (320) to separate the single solid dosage form (not shown) when the receiver (310) is selectively rotated. Sweeper (305) also has a clip (307) for attaching to a sweeper bracket (not shown), so the sweeper (305) can be adjustably positioned proximate to the selection slot (320).

Figure 4:
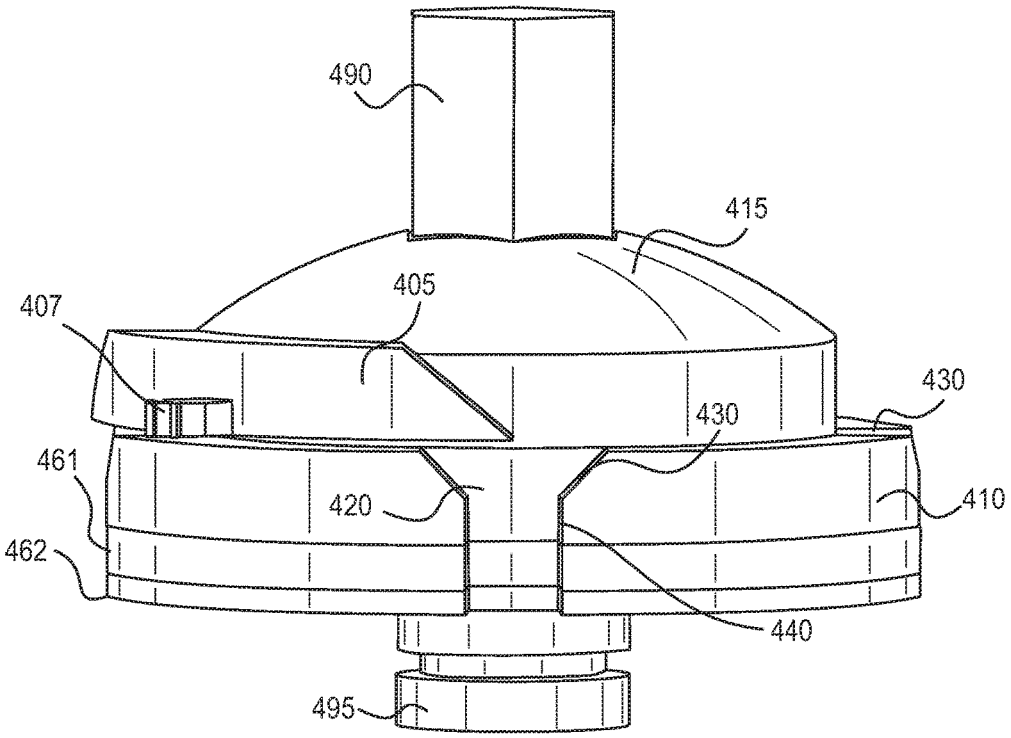
FIG. 4 provides a side view of yet another embodiment of a receiver, coupled to two spacers, along with an axial shaft and sweeper.

FIG. 4 provides a side view of yet another embodiment of a receiver, coupled to two spacers, along with an axial shaft and sweeper. Substantially circular receiver (410), viewed edge-on, has a convex surface (415) to direct solid dosage forms (not shown) to the selection slot (420), so the receiver (410) can separate a single solid dosage form from a plurality of solid dosage forms (not shown). In this embodiment, axial shaft (490) extends through the center of the receiver (410) and the convex surface (415). Selection slot (420) also has guiding portion (430) adapted to introduce a single solid dosage form into the selection slot (420), and transporting portion (440) adapted to move the single solid dosage form (not shown) away from the plurality of solid dosage forms (not shown). The receiver (410) is reversibly coupled to a first spacer (461) and a second spacer (462), which spacers (461, 462) lengthen a dimension of the selection slot (420), in this case, its depth.

Axial shaft (490) has a base (495) adapted to couple to an electric motor (not shown). Also shown in FIG. 4 is a sweeper (405) positioned proximate to the selection slot (420) to aid the selection slot (420) to separate the single solid dosage form (not shown) when the receiver (410) is selectively rotated. Sweeper (405) also has a clip (407) for attaching to a sweeper bracket (not shown), so the sweeper (405) can be adjustably positioned proximate to the selection slot (420).

Figure 5:
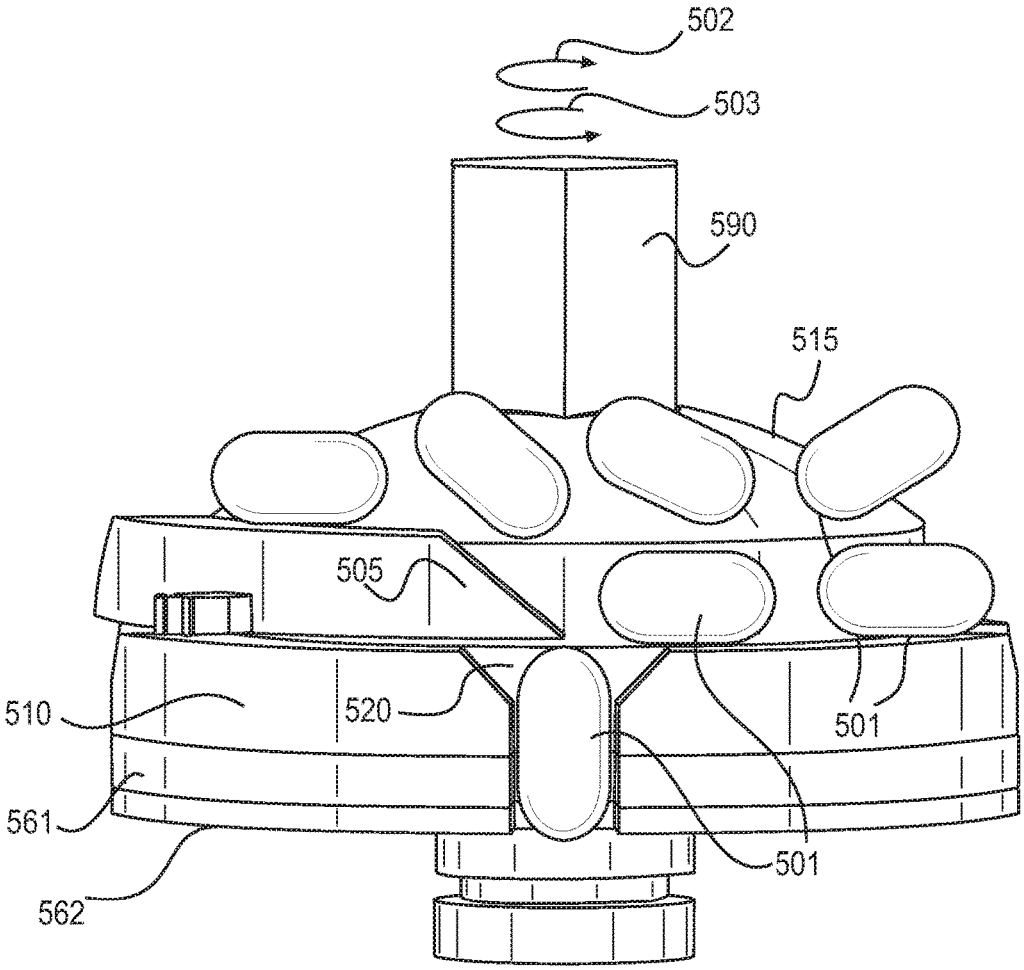
FIG. 5 provides a side view of the embodiment shown in FIG. 4, along with solid dosage forms to illustrate operation.

FIG. 5 provides a side view of the embodiment shown in FIG. 4, along with solid dosage forms to illustrate operation. Substantially circular receiver (510), viewed edge-on, has a convex surface (515) to direct solid dosage forms (501) having the same shape to the selection slot (520), so the receiver (510) can separate a single solid dosage form (501) from a plurality of solid dosage forms (501). A first spacer (561) and a second spacer (562) are reversibly coupled to the receiver (510) in a manner that lengthens the selection slot (520). In this embodiment, axial shaft (590) extends through the center of the receiver (510) and the convex surface (515). When the axial shaft (590), coupled to a motor (not shown) is selectively rotated clockwise (502), the sweeper (505) will cause solid dosage forms (501) not already in the selection slot (520) to be kept from being dispensed, given the current relative positions of the sweeper (505) and the selection slot (520). If a jam develops, then the axial shaft (590) can cause the receiver (510) to rotate counterclockwise (503) in an effort to release the jam. It should be appreciated that the sweeper (505) can be "monodextrous," meaning that the sweeper (505) handles receiver (510) rotating only from one direction, or "ambidextrous," meaning that the sweeper (505) handles receiver (510) rotating in either direction. In the present figure, sweeper (505) is ambidextrous, which can be appreciated by comparison to the sweeper (605) in FIG. 6.

Figure 6:
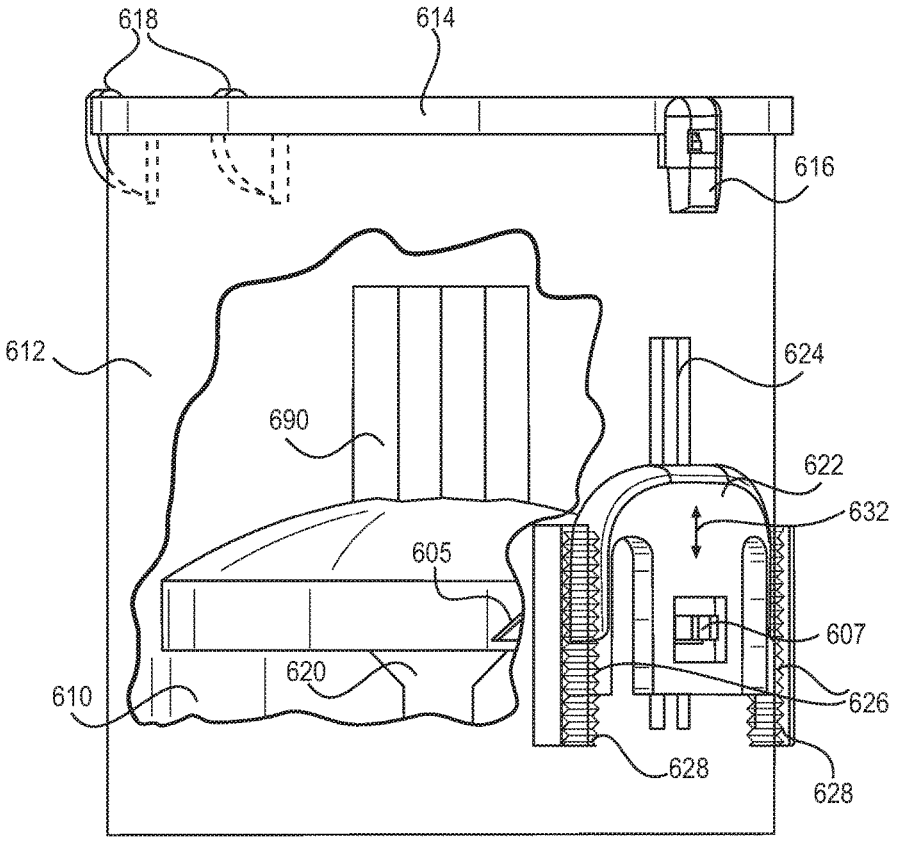
FIG. 6 provides a side view of another embodiment of the present invention, a storage compartment.

FIG. 6 provides a side view of another embodiment of the present invention, a storage compartment. Storage compartment (612) has a lid (614) secured by latch (616) and held to the storage compartment (612) by hinges (618). Coupled to the storage compartment (612) and viewable through the cutaway is a receiver (610) adapted to rotate about an axis defined by axial shaft (690). The receiver (610) has a selection slot (620) adapted to separate a single solid dosage form from a plurality of solid dosage forms when the receiver (610) is selectively rotated clockwise and counterclockwise about the axis. The volume above the receiver (610) bounded by the storage compartment (612) and its lid (614) when closed define a volume for storing a plurality of solid dosage forms (not shown) having a same shape. Ambidextrous sweeper (605) is coupled to the storage compartment (612) by clip (607) which is held by bracket (622). The sweeper (605) is adjustably positioned proximate to the selection slot (620) by the bracket arms (626) which have teeth that engage complementary teeth on a bracket frame (628) affixed to the outside wall of the storage compartment (612). Clip (607) travels through a bracket groove (624) when the bracket (622) and sweeper (605) are moved up or down (632) relative to the storage compartment (612) and the receiver (610).

Figure 7:
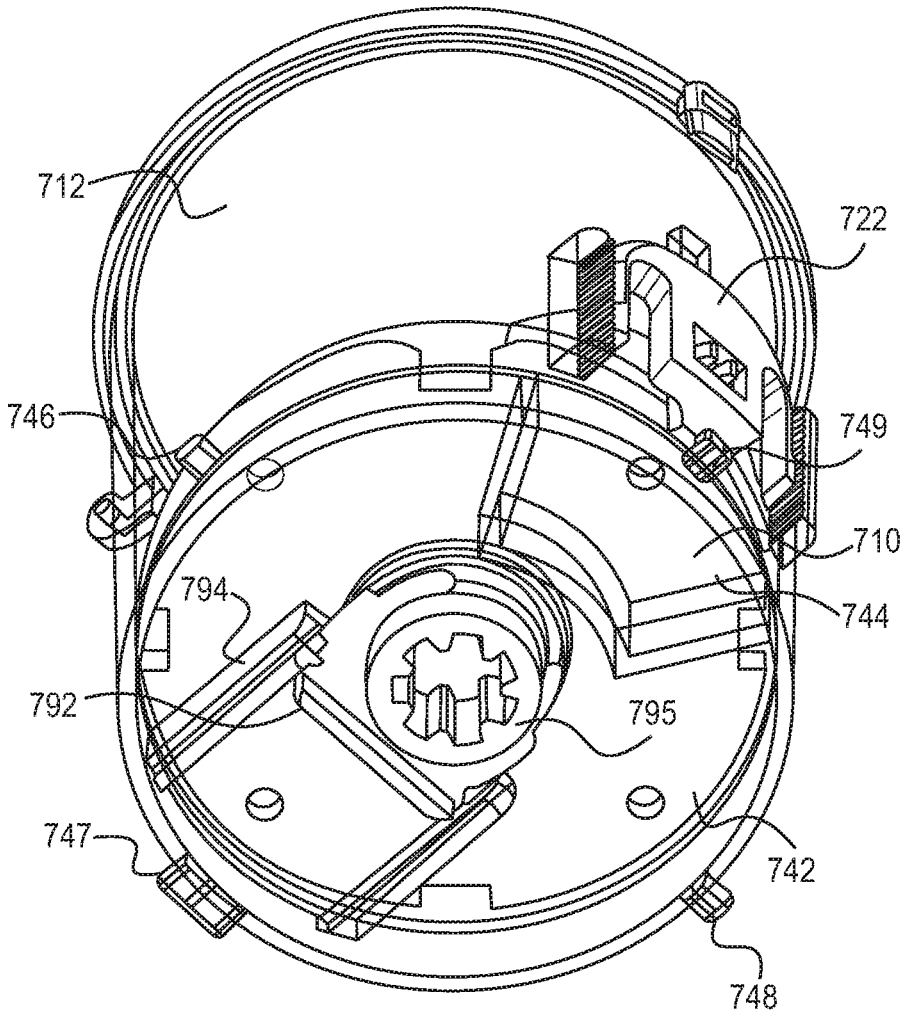
FIG. 7 shows a perspective view from below of the storage compartment shown in FIG. 6.

FIG. 7 shows a perspective view from below of the storage compartment shown in FIG. 6. Storage compartment (712) includes a bracket (722) for holding the sweeper (not shown). The bottom of the receiver (710) is visible through an exit port (744) in the bottom (742) of the storage container (712). When the receiver (710) rotates to position a selection slot (not shown) occupied by a single solid dosage form (also not shown), the solid dosage form would drop through the exit port (744) to be dispensed. Storage compartment (712) also includes pins (746, 747, 748, and 749) positioned around the base of the storage compartment (712) to allow coupling of the storage compartment (712) to a dispensing device (not shown). The pins can have unique widths to ensure proper orientation during coupling. For example, pin (747) is wider than the other pins (746, 748, and 749), so that storage compartment (712) will couple to a dispensing device (not shown) in only one orientation. Proper orientation means that the exit port (744) is positioned over a collection funnel (not shown).

Storage compartment (712) also includes a frame (794) that holds a shaft clip (792) that couples the base (795) of the axial shaft. The shaft clip (792) allows the receiver (710) to couple to the storage compartment (712), and to rotate about an axis defined by the axial shaft and its base (795). Base (795) has teeth allowing engagement with a motor (not shown) that will cause the receiver (710) to selectively rotate.

Figure 8:
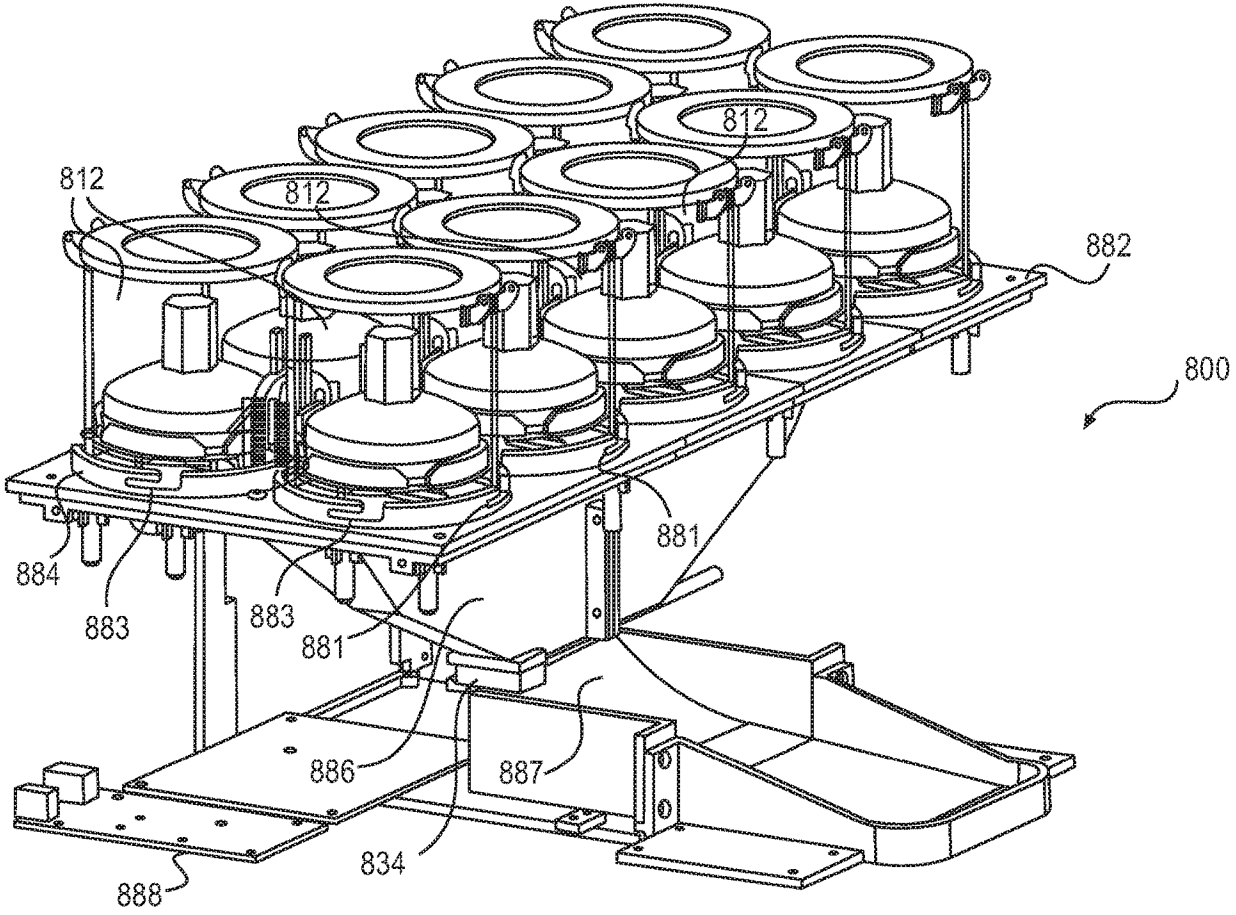
FIG. 8 shows a perspective view of another embodiment, a dispensing device coupled to ten storage compartments.

FIG. 8 shows a perspective view of another embodiment, a dispensing device coupled to ten storage compartments. Dispensing device (800) includes a coupling deck (882) having coupling structure (884). Coupling structure (884) has coupling slots (881, 883) adapted to receive the pins (747, 748, for example: see FIG. 7) that allow secure coupling in the proper orientation between the storage compartments (812) and the coupling deck (882). When a single solid dosage form is dispensed from a storage compartment (812), it drops into collection funnel (886), whereupon it passes to the dispensing ramp (887). As the single solid dosage form passes from collection funnel (886), its passage is detected by fiberoptic array (834). Computing hardware (888) including a processor (not shown) can be included in a dispensing device (800) for any suitable purpose. For example, computing hardware (888) can manage a patient's medicine and dietary supplement regimen, alert the patient or caregiver that the time for a pharmaceutical and nutraceutical consumption event is imminent, indicate that one or more storage compartments (812) need to be refilled, dispense and detect the dispensing of solid dosage forms, and/or detect and resolve jamming, in accordance with various embodiments of the present invention.

Figure 9:
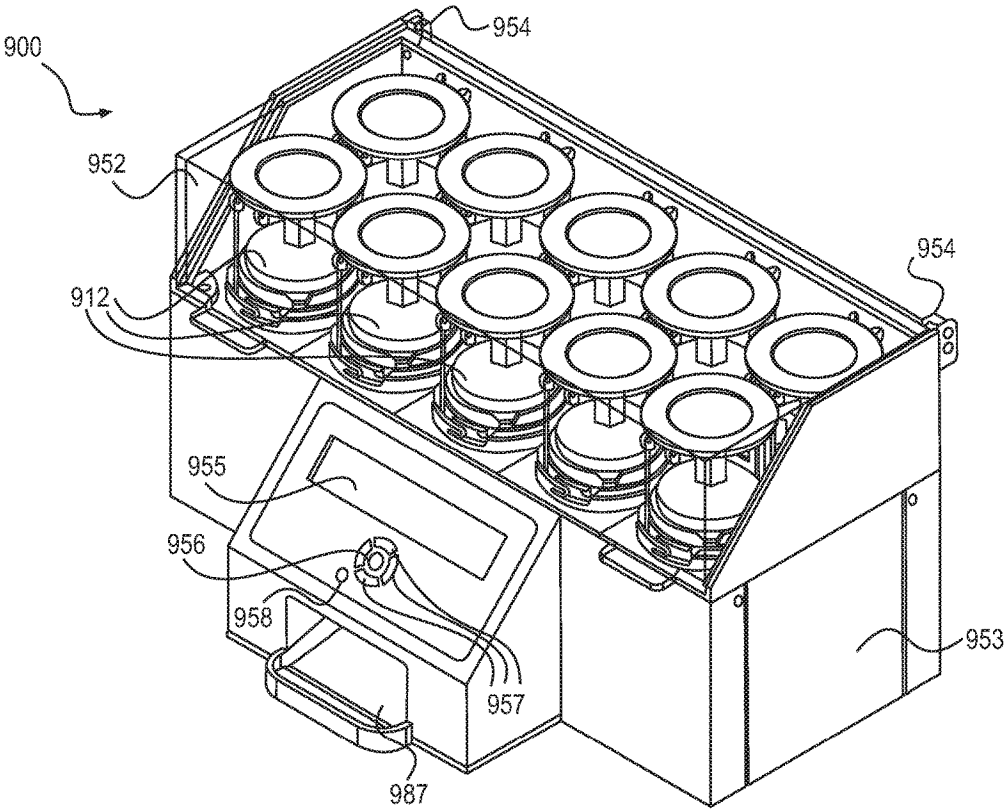
FIG. 9 shows a perspective view of yet another embodiment, a dispensing device.

FIG. 9 shows a perspective view of yet another embodiment, a dispensing device. Dispensing device (900) could contain the dispensing device (800) of FIG. 8. Dispensing device (900) comprises a housing (953) and a lid (952) operably attached to the housing (953) with hinges (954). Dispensing device (900) also includes storage compartments (912) coupled to receivers (not shown). When solid dosage forms are dispensed from storage compartments (912), the solid dosage forms would appear at dispensing ramp (987). Display (955) is configured to display images and/or messages to an operator such as a patient or caregiver. Any suitable display component can be used, such as, for example, a liquid crystal display, or a touch screen such as a piezoelectric touch screen. A "select" button (956) is surrounded by navigation buttons (957). An operator could use buttons (956, 957) to navigate through menus and submenus appearing on the display (955) to dispense solid dosage forms, resolve problems such as jams and empty storage compartments (912), input pharmaceutical and nutraceutical consumption events, schedules, or even entire regimens, and to obtain messages or instructions such as, for example, "Take with food." PRN button (958) illuminates to indicate that "PRN" or "as-needed" medications are available. When PRN button (958) is pressed, a list of available medications appears on display (955), and the patient or caregiver will use navigation buttons (957) and select button (956) to select and dispense required medication. In another embodiment not shown here, visual display (955) is a piezoelectric touch screen that encompasses the functionality of buttons (956, 957) and PRN button (958). An audible device (not shown) also can be used to signal information to a patient or a caregiver.

Figure 10:
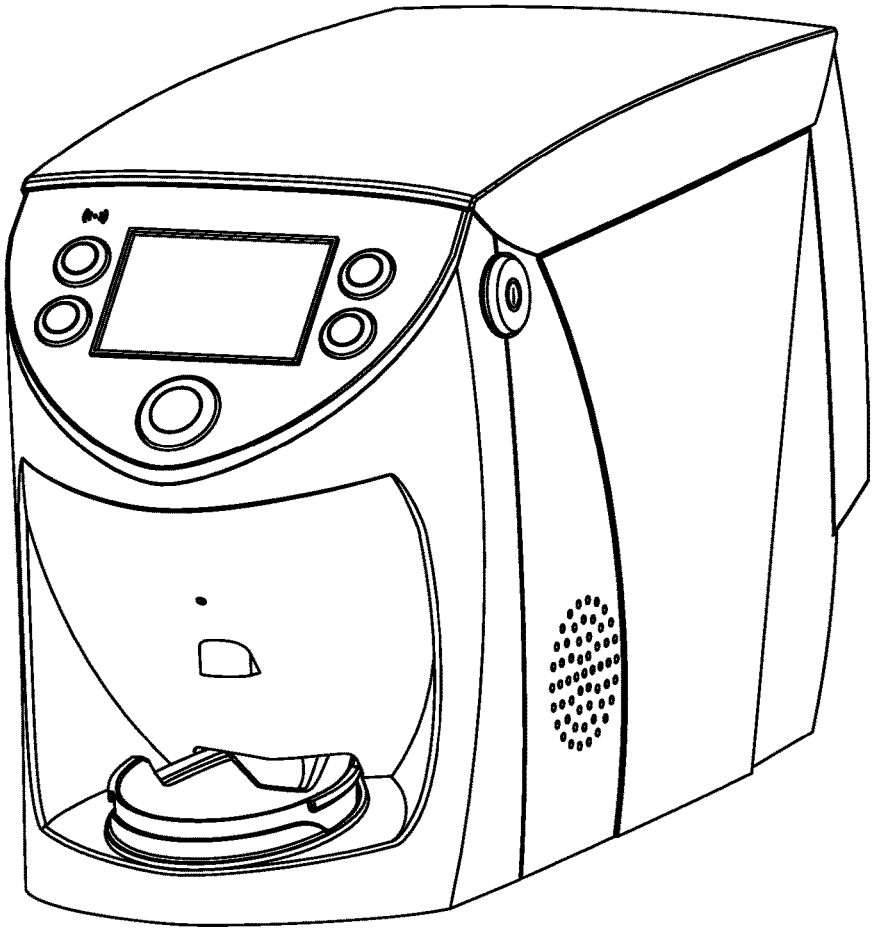
FIGS. 10-16 show several views of a further embodiment of the present invention, a dispensing device.
Figure 11:
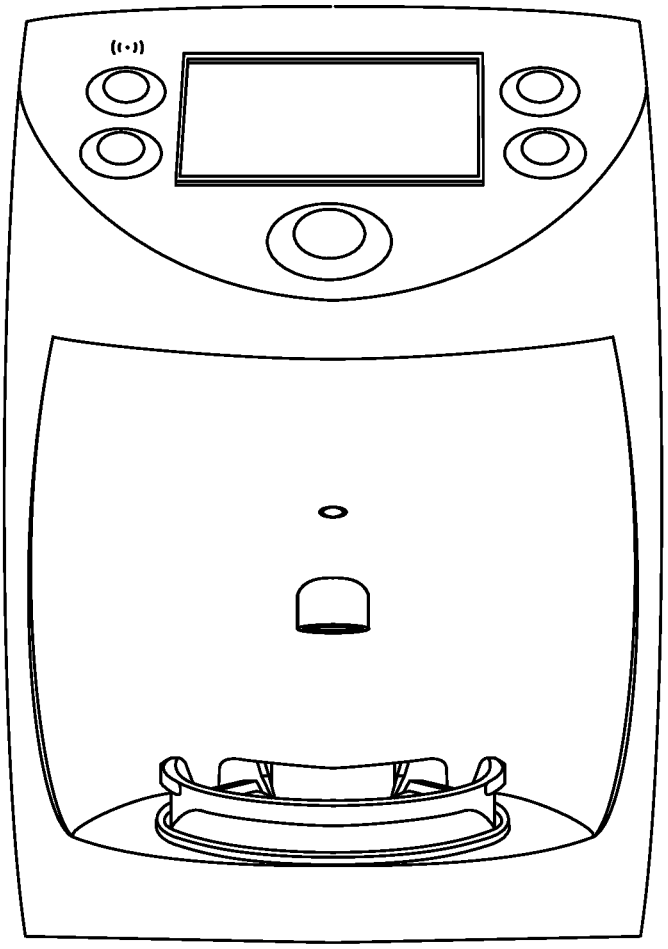
Figure 12:
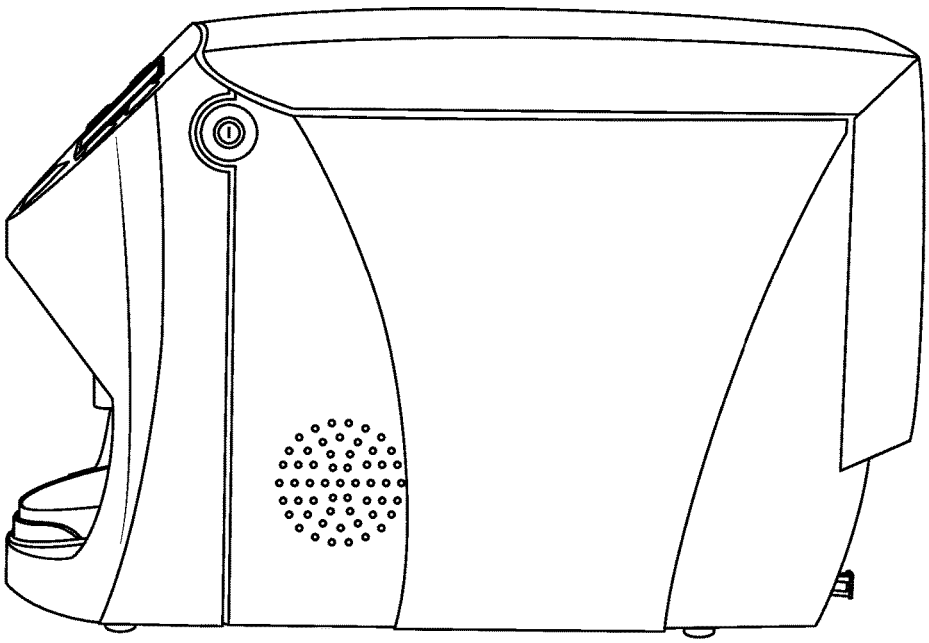
Figure 13:
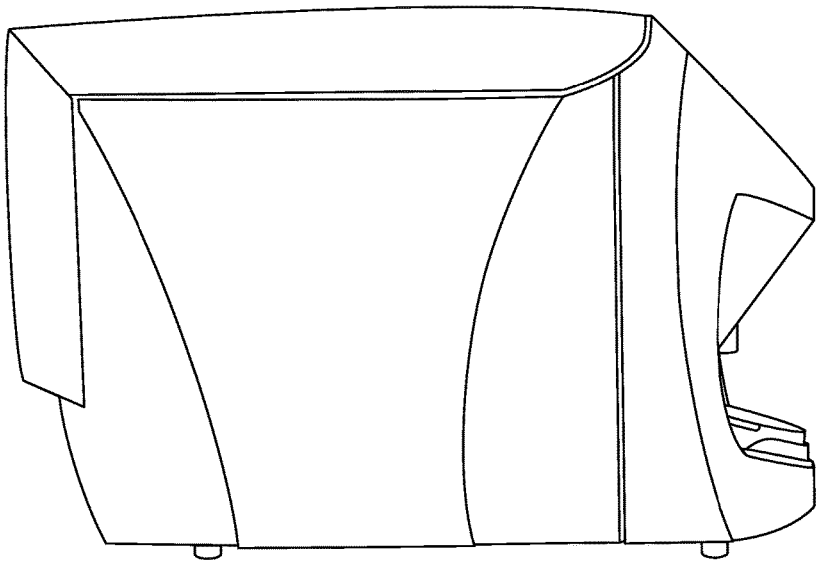
Figure 14:
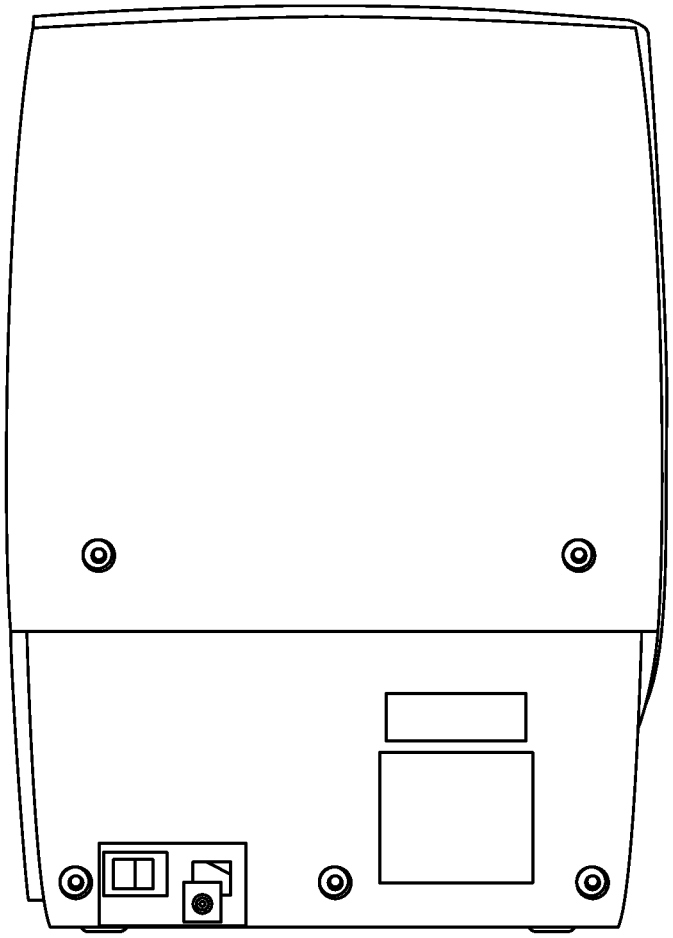
Figure 15:
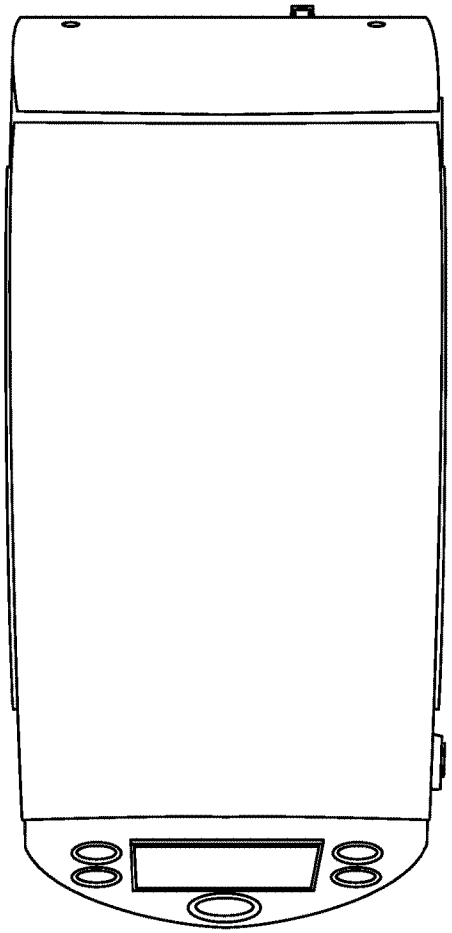
Figure 16:
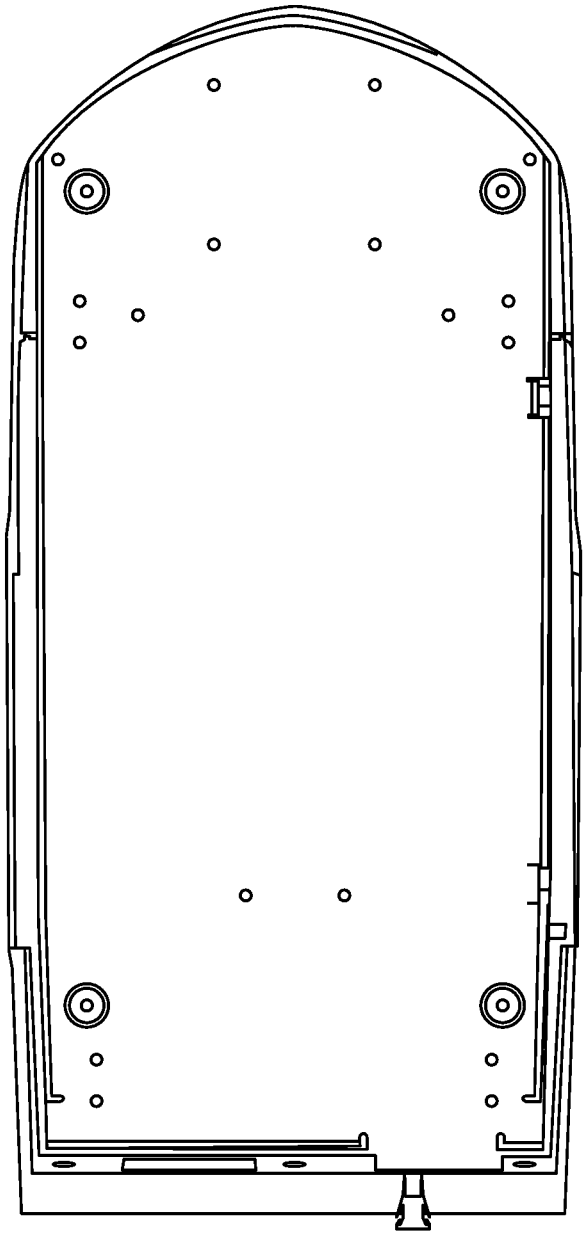

FIGS. 10-16 show several views of a further embodiment of the present invention, a dispensing device. FIG. 10 shows a perspective view of the entire device, viewing the front, left, and top of the device. FIG. 11 shows a front view, while FIG. 12 illustrates a left view. FIG. 13 shows the right side, and 14 shows the back. FIG. 15 shows a top view, and 16 shows the bottom.

Figure 17:
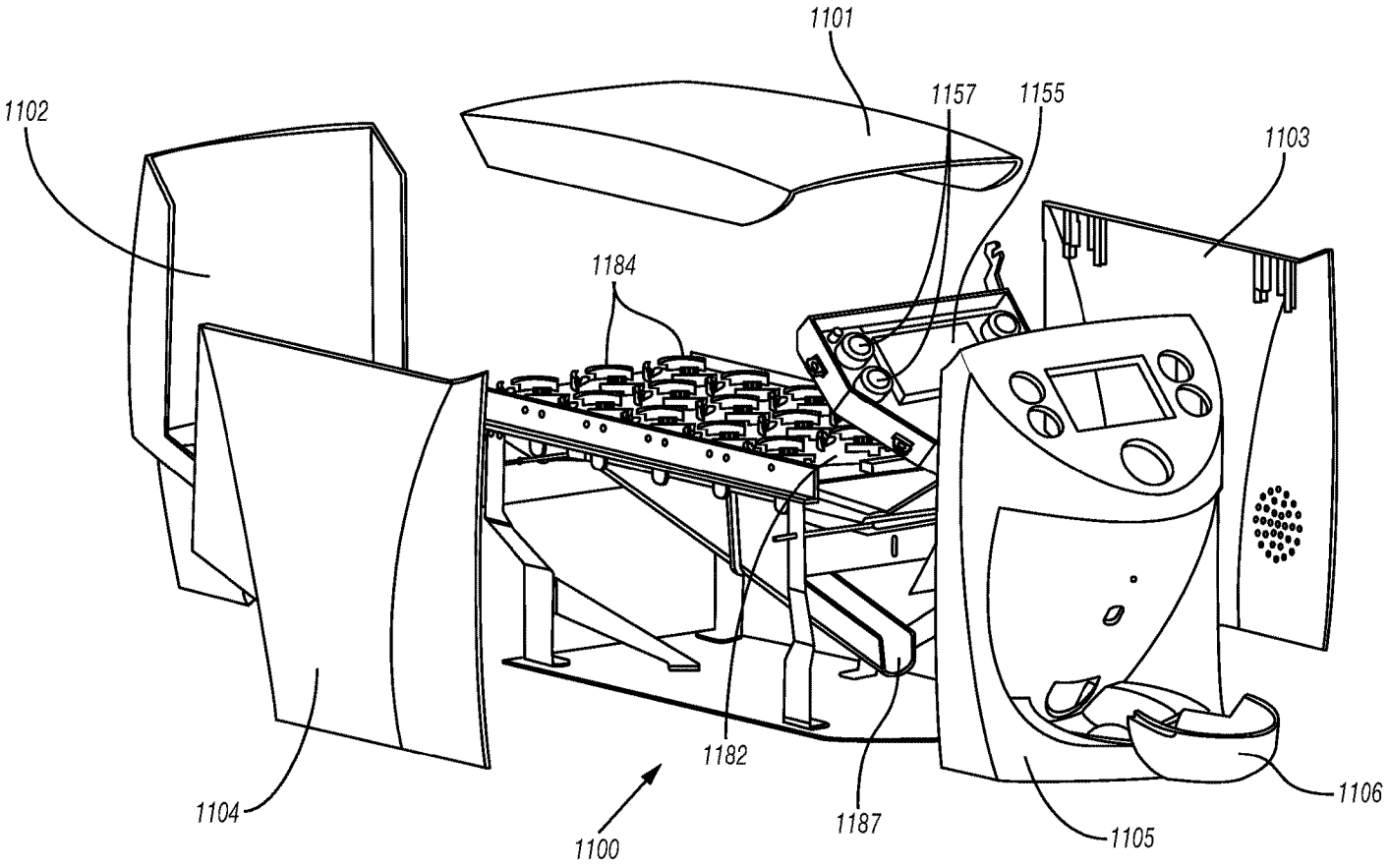
FIG. 17 shows another view of the embodiment depicted in FIG. 10, with body panels (1101, 1102, 1103, 1104, 1105) and dispensing cup (1106) shown in "exploded" format.

FIG. 17 shows another view of the embodiment depicted in FIG. 10, with body panels (1101, 1102, 1103, 1104, 1105) and dispensing cup (1106) shown in "exploded" format. Dispensing device (1100) has a front panel (1105), left panel (1103), top panel (1101), rear panel (1102), and right panel (1104). Dispensing cup (1106) is adapted to receive solid dosage forms emerging from the dispensing ramp (1187), and can be reversibly removed from the dispensing device (1100) to transport the solid dosage forms to the patient. In this embodiment, the dispensing ramp (1187) is positioned below the coupling deck (1182) to receive solid dosage forms as they emerge from storage compartments (not shown). Coupling structures (1184) allow storage compartments (not shown) to reversibly couple to the coupling deck (1182). Menu navigation buttons (1157) appear alongside a visual display (1155).

Figure 18:
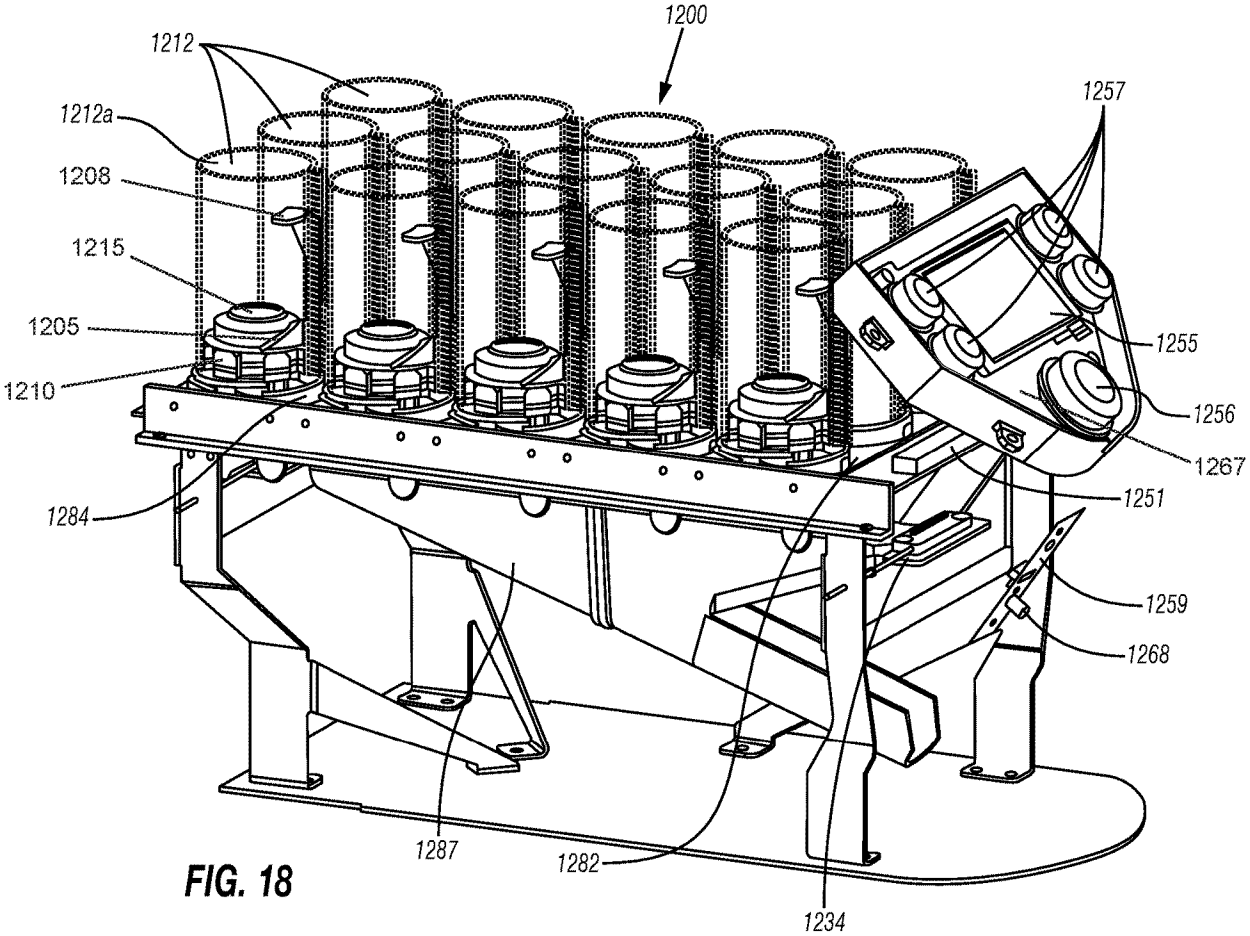
FIG. 18 shows a right side perspective view of the dispensing device depicted in FIG. 17 without the body panels (1101, 1102, 1103, 1104, 1105) and dispensing cup (1106).

FIG. 18 shows a right side perspective view of the dispensing device depicted in FIG. 17 without the body panels (1101, 1102, 1103, 1104, 1105) and dispensing cup (1106). Dispensing ramp (1287) is positioned below the coupling deck (1282) to receive solid dosage forms emerge from storage compartments (1212). Not all storage compartments (1212) are labeled for clarity. Fiberoptic array (1234) is positioned to detect solid dosage forms coming down the dispensing ramp (1287). Visible in a storage compartment (1212*a*) is receiver (1210) having a convex surface (1215). Also visible is sweeper (1205) and a thumb tab (1208) for positioning the sweeper (1205). Coupling structure (1284) reversibly couples the storage compartment (1212) to the coupling deck (1282). Menu navigation buttons (1257) appear alongside visual display (1255) and a select button (1256) on the main printed circuit board (1267). Data connector (1251) allows for electrical communication between the main printed circuit board (1267), on the one hand, and the container printed circuit board (not show) attached to the bottom of the coupling deck (1282) to selectively activate the motors (not shown) to selectively rotate the receivers (1210). Microphone (1259) allows a user to respond to audio or visual cues, thereby controlling the dispensing device (1200) by voice command. Also, microphone (1259) can be configured to detect the sound of a solid dosage form emerging from the dispensing ramp (1287) and landing in the dispensing cup (1106, not shown). Furthermore, microphone (1259) can be used to allow a user to communicate with a remote health care professional if the device (1200) is in electrical communication with a network such as the Internet. Light (1268) can be configured to illuminate the dispensing cup (not shown) when solid dosage forms are dispensed into the dispensing cup.

Figure 19:
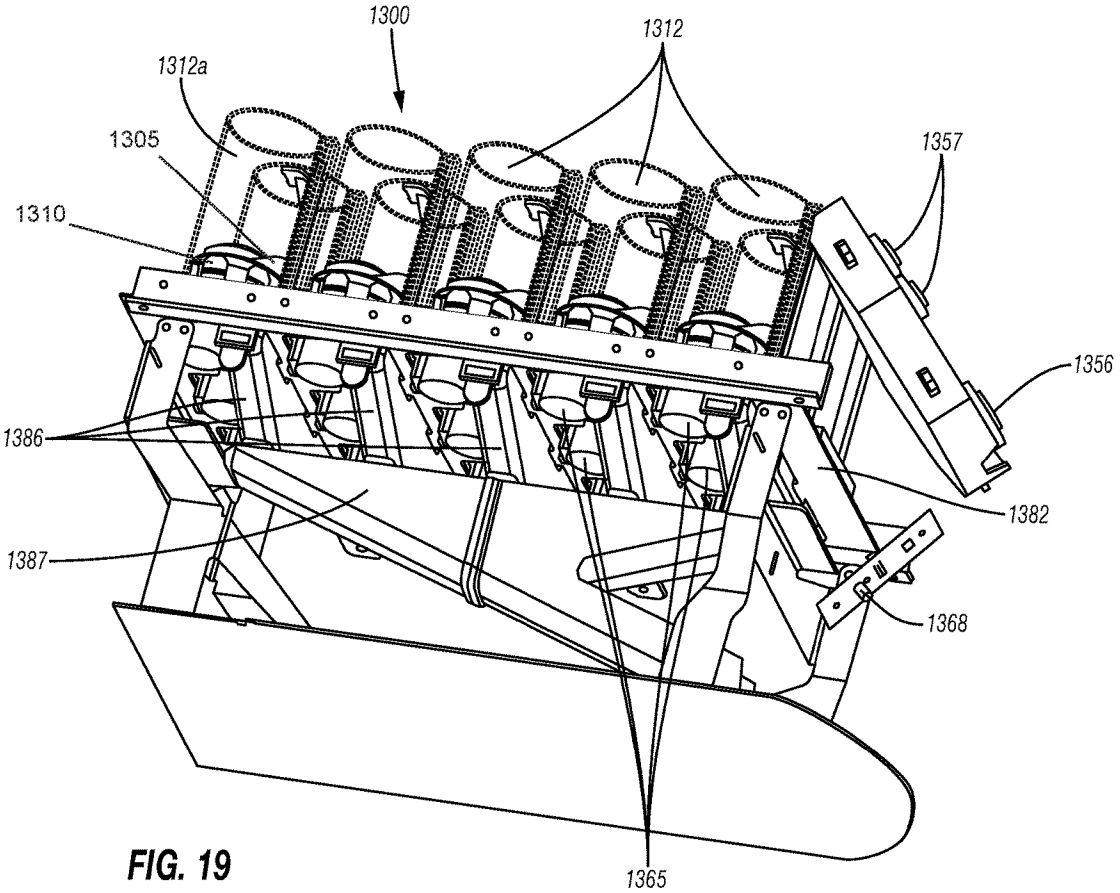
FIG. 19 shows a right side perspective view from below of the dispensing device depicted in FIG. 17 without the body panels (1101, 1102, 1103, 1104, 1105) and dispensing cup (1106).

FIG. 19 shows a right side perspective view from below of the dispensing device depicted in FIG. 17 without the body panels (1101, 1102, 1103, 1104, 1105) and dispensing cup (1106). Dispensing device (1300) includes collection funnels (1386) that are interposed between the dispensing ramp (1387) and coupling deck (1382). Underneath each storage compartment (1312) is a motor housing (1365) operable to rotate an axial shaft (not shown) that in turn rotates the receiver (for example, 1310) in each storage compartment (for example, 1312*a*). Also visible in storage compartment (1312*a*) is sweeper (1305). Menu navigation buttons (1357) and allow a user of dispensing device (1300) to manually control the device (1300). Light (1368) can be configured to illuminate the dispensing cup (not shown) when solid dosage forms are dispensed into the dispensing cup.

Figure 20:
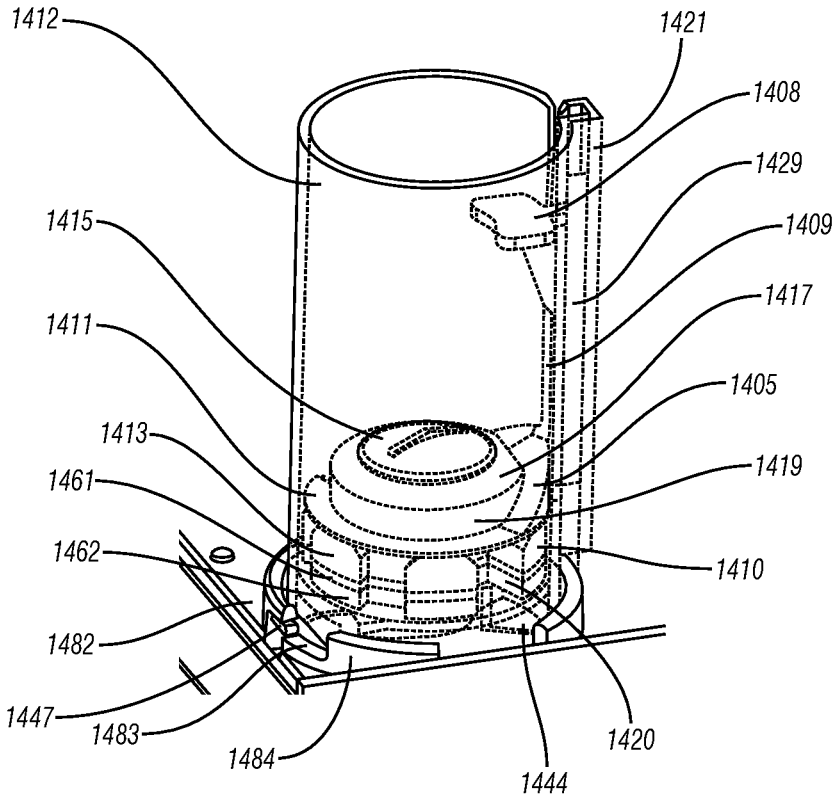
FIG. 20 depicts a semi-transparent perspective view of a storage compartment coupled to the device depicted in FIG. 17.

FIG. 20 depicts a semi-transparent perspective view of a storage compartment coupled to the device depicted in FIG. 17. Storage compartment (1412) is reversibly coupled to the coupling deck (1482) via coupling structure (1484) that includes coupling slot (1483) that receives coupling pin (1447) affixed to storage compartment (1412). Storage compartment (1412) also has a sweeper niche (1421) that receives sweeper shaft (1409). The interior of the sweeper niche (1421) has teeth (1429) that engage corresponding teeth or other structure (not shown) on sweeper shaft (1409) to position the sweeper (1405) within the storage compartment (1412) and at the correct position relative to the receiver (1410). Sweeper shaft (1409) includes a thumb tab (1408) that allows a user to manipulate the sweeper shaft (1409). Sweeper shaft (1409) allows the positioning of the sweeper (1405) relative to the convex surface (1415) of the receiver (1410). In this embodiment, sweeper (1405) includes a convex adapter (1417) that augments the convex surface (1415) in defining the space between the interior wall of storage compartment (1412) and the receiver (1410). In some cases, the distance between the outer surface (1419) of the convex adapter (1417) and the interior wall of storage compartment (1412) corresponds to a dimension of the solid dosage form (not shown) to be dispensed from that storage compartment (1412). Receiver (1410) comprises convex surface (1415), selection slot selector (1411), and selection slot carrier (1413). Receiver (1410) is reversibly coupled to a first spacer (1461) and a second spacer (1462). The selection slot carrier (1413) together with the first spacer (1461) and second spacer (1462) define a selection slot (1420), which is positioned by rotation of the receiver (1410) over exit port (1444). In this case, selection slot selector (1411) is positioned to select a selection slot on the far side of selection slot carrier (1413), so that when receiver (1410) is rotated relative to sweeper (1405), only one selection slot will be employed to separate and dispense a solid dosage form through exit port (1444). This allows selection slots of various dimensions to appear on a selection slot carrier, while providing only one selection slot having the proper dimensions for a given solid dosage form.

Figure 21:
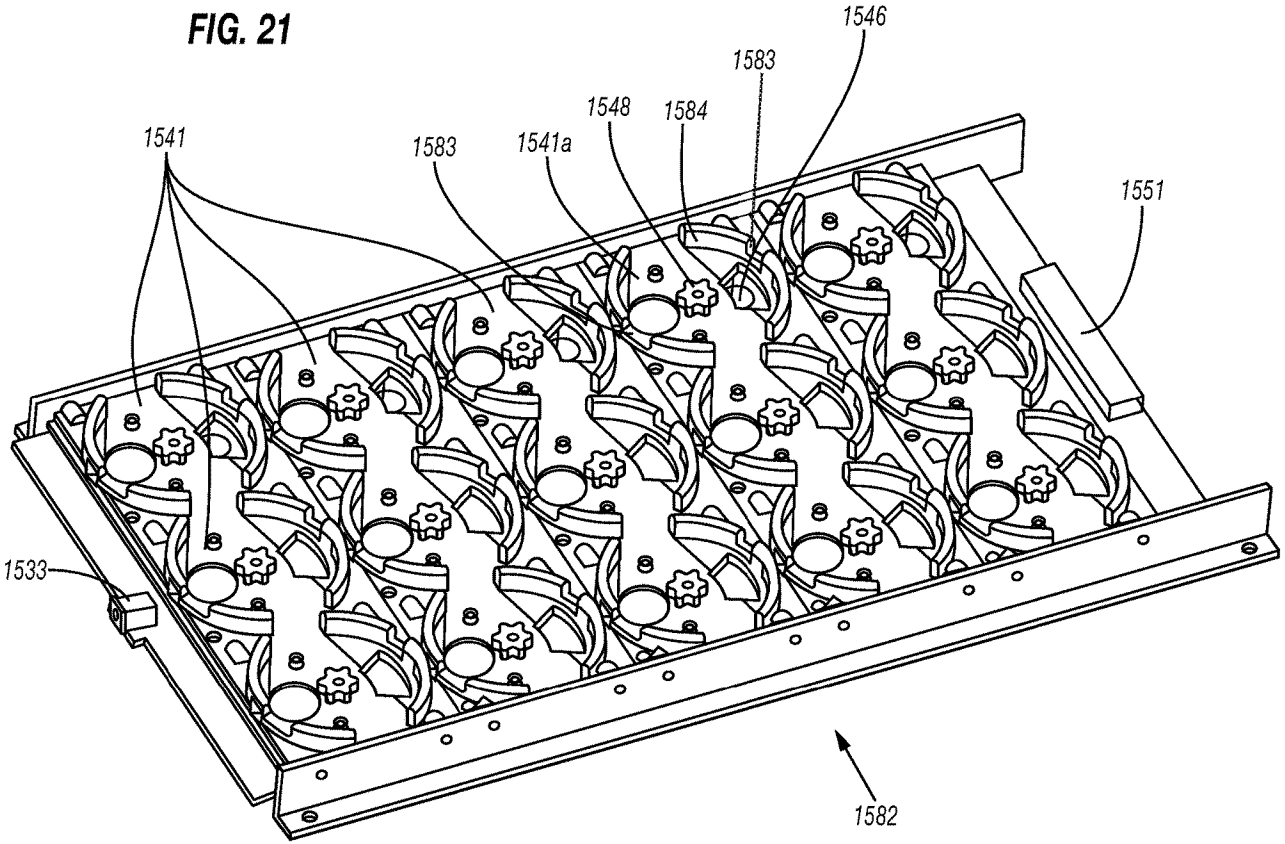
FIG. 21 depicts a perspective view of an embodiment of a coupling deck.

FIG. 21 depicts a perspective view of an embodiment of a coupling deck (1582). Eighteen coupling sites (1541), able to reversibly couple eighteen storage compartments (not shown), appear on coupling deck (1582). Coupling site (1541*a*) includes coupling structure (1584) further including coupling slots (1583) adapted to reversibly couple a storage compartment (not shown) by engaging pins on the storage compartment. Coupling site (1541*a*) defines an exit opening (1546) arranged so that it will align with an exit port (for example, 1444 in FIG. 20) of a storage compartment (not shown). Data connector (1551) allows for electrical communication between main printed circuit board (not shown) and the container printed circuit board (not shown), so that each coupling site (1541) can be selectively activated. The container printed circuit board (not shown) can be affixed underneath the coupling deck (1582), and allows for electrical communication with the motors (not shown) driving the axial gears (1548). Coupling site (1541*a*), for example, can be selectively activated by an electronic signal causing a motor (not shown) to turn an axial gear (1548) in contact with an axial shaft and its base (for example, 795 in FIG. 7). Power connection (1533) provides electrical power to the motors (not shown) driving the axial gear (1548, for example) of each coupling site (1541*a*, for example).

Figure 22:
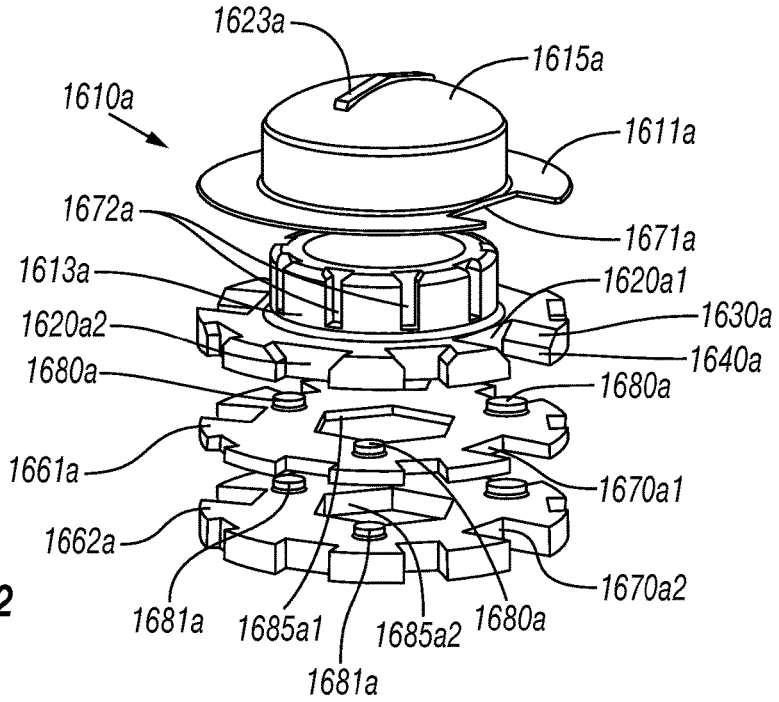
FIGS. 22 and 23 depict two embodiments of a receiver comprising a selection slot selector and a selection slot carrier, along with two spacers.
Figure 23:
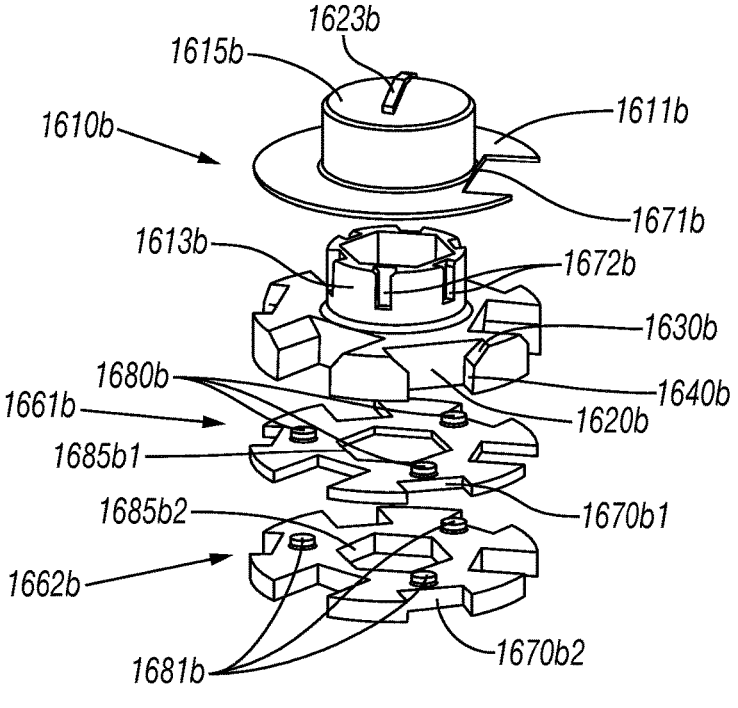

FIGS. 22 and 23 depict two embodiments of a receiver comprising a selection slot selector and a selection slot carrier, along with two spacers, in "exploded" format. A receiver together with one or more spacers can be called a receiver-spacer assembly. In FIG. 22, receiver (1610*a*) comprises selection slot selector (1611*a*) and selection slot carrier (1613*a*). Selection slot selector (1611*a*) includes convex surface (1615*a*), agitator (1623*a*), and selector opening (1671*a*). Agitator (1623*a*) aids in orienting solid dosage forms when the receiver (1610*a*) is rotated. Selection slot carrier (1613*a*) comprises a number of selection slots (for example, 1620*a*1, 1620*a*2) around its circumference. Selector opening (1671*a*) is positioned over a desired selection slot (1620*a*1). Selection slot selector (1611*a*) reversibly engages selection slot carrier (1613*a*) via engagement slots (1672*a*). Selection slot (1620*a*1), for example, comprises guiding portion (1630*a*) and transporting portion (1640*a*). Receiver (1610*a*) reversibly engages first spacer (1661*a*) via spacer pins (1680*a*). First spacer (1661*a*) includes a number of slots such as slot (1670*a*1) around its circumference. First spacer (1661*a*) also includes opening (1685*a*1) adapted to receive an axial shaft (not shown). First spacer (1661*a*) reversibly engages second spacer (1662*a*) via spacer pins (1681*a*). Second spacer (1662*a*) includes a number of slots such as slot (1670*a*2) around its circumference. Slot (1670*a*1) and slot (1670*a*2) are adapted to align with selection slot (1620*a*1) and selector opening (1671*a*) to provide the proper dimensions for separating a solid dosage form from a plurality of solid dosage forms having the same shape in a storage compartment (not shown) in which the receiver-spacer assembly shown in FIG. 22 appears.

In FIG. 23, receiver (1610*b*) comprises selection slot selector (1611*b*) and selection slot carrier (1613*b*). Selection slot selector (1611*b*) includes convex surface (1615*b*), agitator (1623*b*), and selector opening (1671*b*). Agitator (1623*b*) aids in orienting solid dosage forms when the receiver (1610*a*) is rotated. Selection slot carrier (1613*b*) comprises a number of selection slots (for example, 1620*b*) around its circumference. Selector opening (1671*b*) is positioned over a desired selection slot (1620*b*). Selection slot selector (1611*b*) reversibly engages selection slot carrier (1613*b*) via engagement slots (1672*b*). Selection slot (1620*b*), for example, comprises guiding portion (1630*b*) and transporting portion (1640*b*). Receiver (1610*b*) reversibly engages first spacer (1661*b*) via spacer pins (1680*b*). First spacer (1661*b*) includes a number of slots such as slot (1670*b*1) around its circumference. First spacer (1661*b*) also includes opening (1685*b*1) adapted to receive an axial shaft (not shown). First spacer (1661*b*) reversibly engages second spacer (1662*b*) via spacer pins (1681*b*). Second spacer (1662*b*) includes a number of slots such as slot (1670*b*2) around its circumference. Slot (1670*b*1) and slot (1670*b*2) are adapted to align with selection slot (1620*b*1) and selector opening (1671*b*) to provide the proper dimensions for separating a solid dosage form from a plurality of solid dosage forms having the same shape in a storage compartment (not shown) in which the receiver-spacer assembly shown in FIG. 23 appears. It can be appreciated that the receiver-spacer assembly of FIG. 22 is designed to handle solid dosage forms of smaller dimensions than those for which the receiver-spacer assembly of FIG. 23 is designed to handle.

Figures 24, 25, 26:
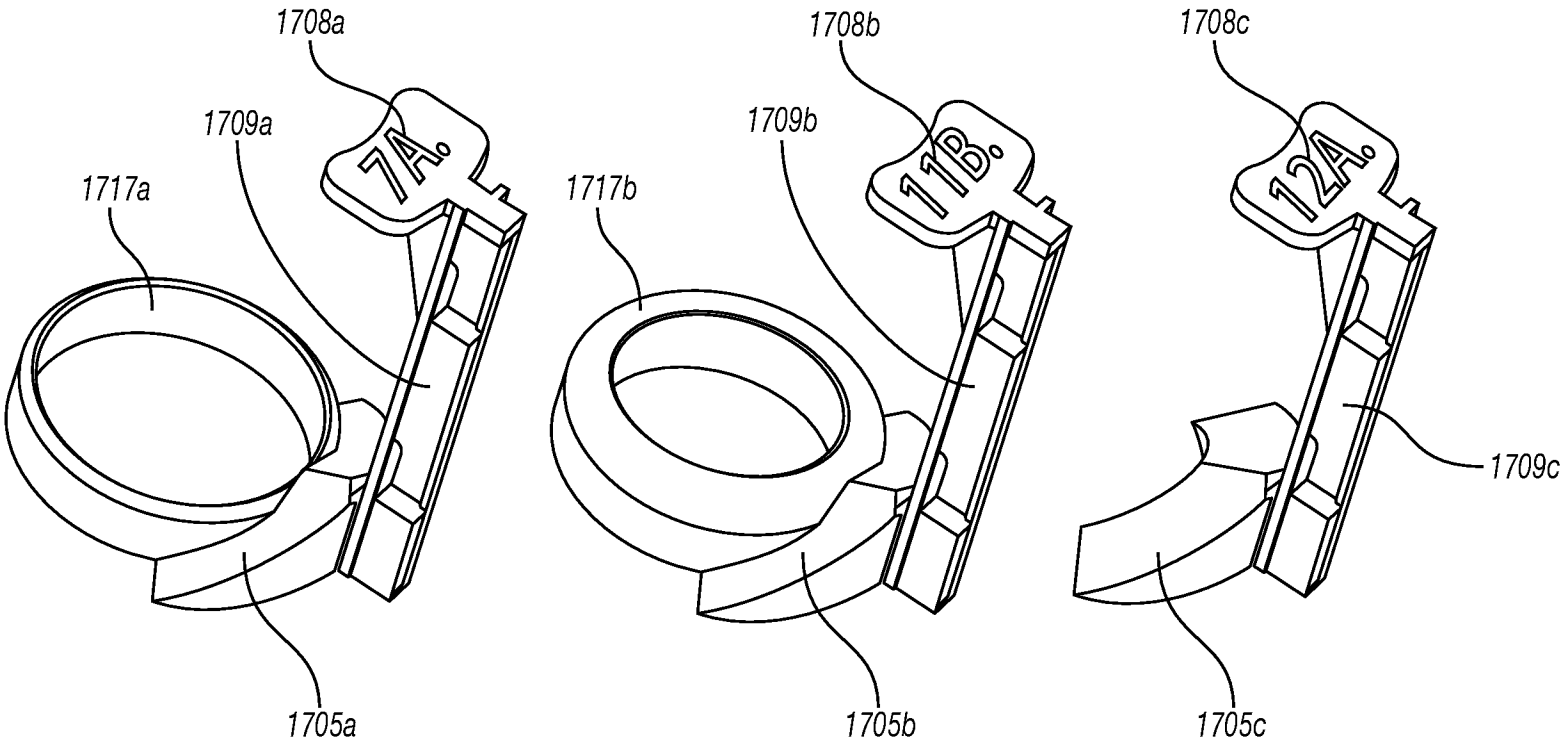
FIGS. 24, 25, and 26 depict three embodiments of sweepers coupled to sweeper shafts having thumb tabs. Two of the embodiments further comprise convex adapters.

FIGS. 24, 25, and 26 depict three embodiments of sweepers coupled to sweeper shafts having thumb tabs. Two of the embodiments further comprise convex adapters. In FIG. 24, sweeper shaft (1709*a*) includes a thumb tab (1708*a*) useful for handling and positioning the sweeper (1705*a*) in a storage compartment (not shown). Attached to the sweeper (1705*a*) is a convex adapter (1717*a*) designed to augment the convex surface of a receiver (not shown). Optionally, sweeper shaft (1709*a*) further comprises teeth or other structure (not shown) designed to engage the teeth in a sweeper niche such as sweeper niche (1421) in FIG. 20. In FIG. 25, sweeper shaft (1709*b*) includes a thumb tab (1708*b*) useful for handling and positioning the sweeper (1705*b*) in a storage compartment (not shown). Attached to the sweeper (1705*b*) is a convex adapter (1717*b*) designed to augment the convex surface of a receiver (not shown). Optionally, sweeper shaft (1709*b*) further comprises teeth or other structure (not shown) designed to engage the teeth in a sweeper niche such as sweeper niche (1421) in FIG. 20. In FIG. 26, sweeper shaft (1709*c*) includes a thumb tab (1708*c*) useful for handling and positioning the sweeper (1705*c*) in a storage compartment (not shown). Optionally, sweeper shaft (1709*c*) further comprises teeth or other structure (not shown) designed to engage the teeth in a sweeper niche such as sweeper niche (1421) in FIG. 20. As can be appreciated from a visual comparison of the three embodiments shown in FIGS. 24-26, sweeper (1705*c*) in FIG. 26 is designed to handle the largest solid dosage forms of the three, while sweeper (1705*b*) is designed to handle the smallest solid dosage forms of the three. Thumb tabs (1708*a*, 1708*b*, 1708*c*) display optional sizing information to assist the user in selecting and deploying the correct sweeper for the dimensions of a given solid dosage form.

Figure 28:
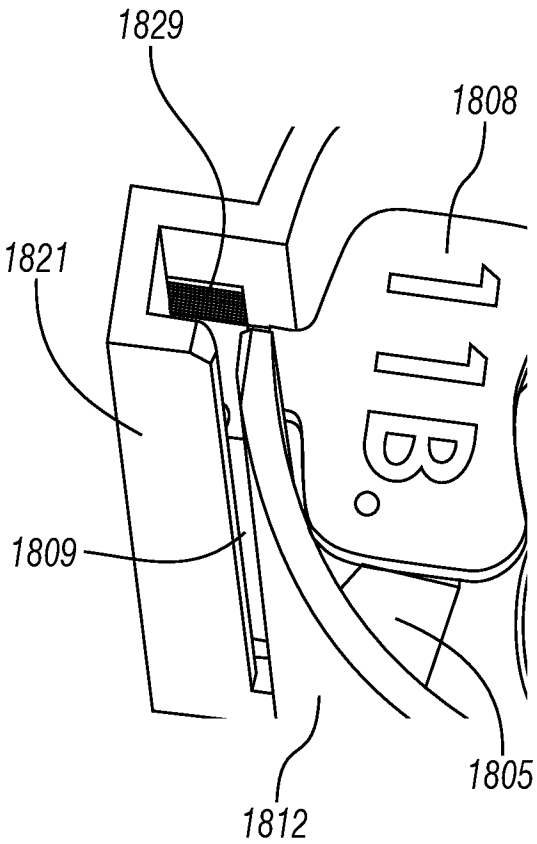
FIGS. 27-29 depict perspective views of an embodiment of a storage compartment.
Figure 27:
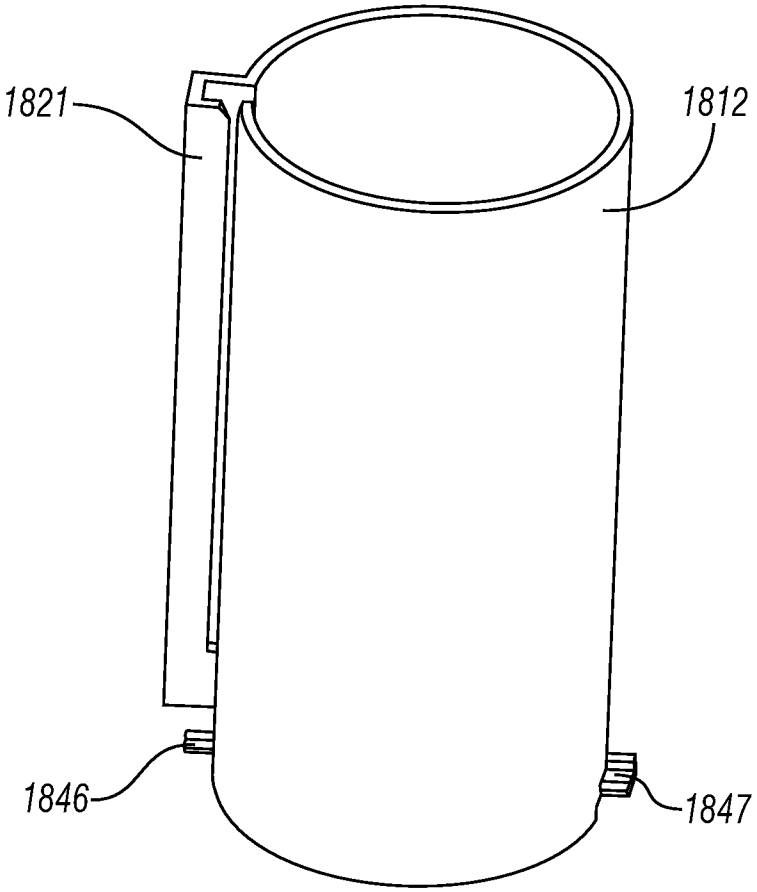
Figure 29:
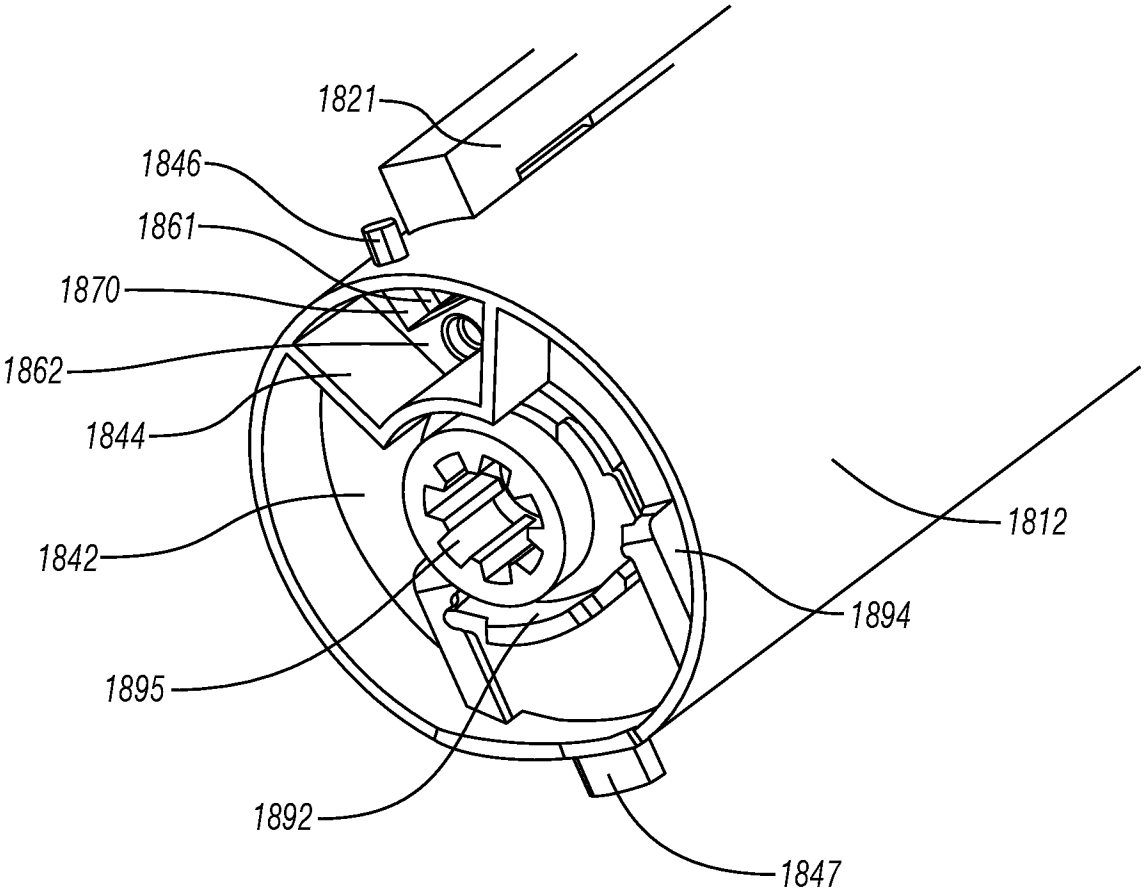

FIGS. 27, 28, and 29 depict perspective views of a storage compartment. In FIG. 27, storage compartment (1812) comprises a sweeper niche (1821) and pins (1846, 1847) adapted to reversibly engage the coupling structure of a coupling deck (not shown). Pin (1847) is wider than pin (1846) to ensure proper orientation of the storage compartment (1812) relative to the coupling deck (not shown). FIG. 28 reveals the presence of a sweeper (1805), sweeper shaft (1809), and some tab (1808) deployed inside storage compartment (1812). Teeth (1829) engage structure (not shown) on sweeper shaft (1809) to reversibly engage sweeper shaft (1809) and hold sweeper (1805) in the proper position relative to the receiver (not shown). Thumb tab (1808) displays optional sizing information. FIG. 29 shows a bottom perspective view of storage compartment (1812) including the aforementioned sweeper niche (1821) and pins (1846, 1847). The bottom (1842) of storage compartment (1812) comprises a frame (1894) that holds a shaft clip (1892) that couples the base (1895) of the axial shaft (not shown). The shaft clip (1892) allows the receiver (not shown), first spacer (not shown), and second spacer (1862) to couple to the storage compartment (1812), and to rotate about an axis defined by the axial shaft and its base (1895). Base (1895) has teeth allowing engagement with a motor (not shown) that will cause the receiver, first spacer, and second spacer (1862) to selectively rotate. Visible through exit port (1844) in the bottom (1842) is second spacer (1862) and first spacer (1861), and slot (1870). When slot (1870) contains a solid dosage form and is aligned with exit port (1844), the solid dosage form can exit the storage compartment (1812). Optionally, storage compartment (1812) is fitted with a lid (not shown) to aid in containing the solid dosage forms and keeping them clean and dry. Further optionally, a desiccant packet (not shown) can be included or affixed inside storage compartment (1812) to further protect the solid dosage forms.

Figure 30:
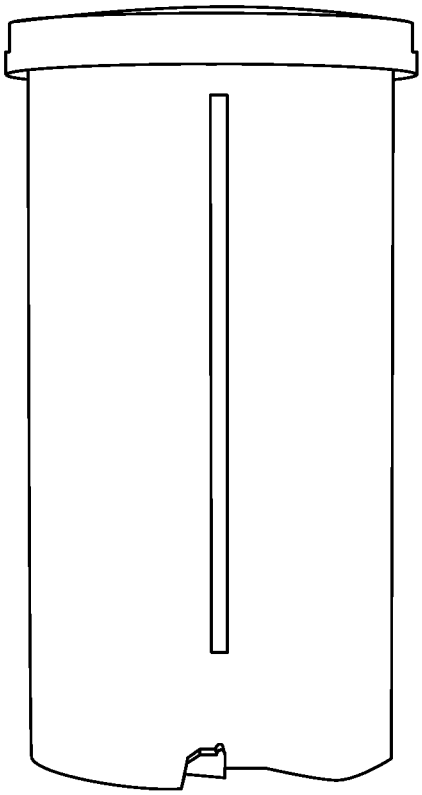
FIGS. 30-37 show several views of a further embodiment of the present invention, a storage compartment with lid.
Figure 31:
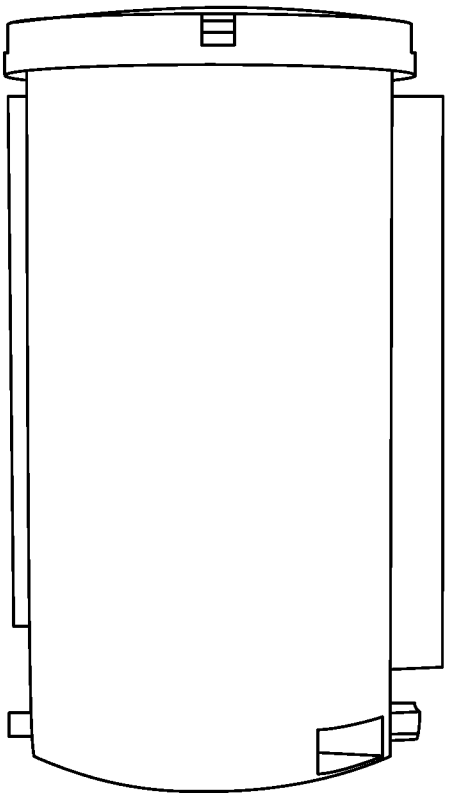
Figure 32:
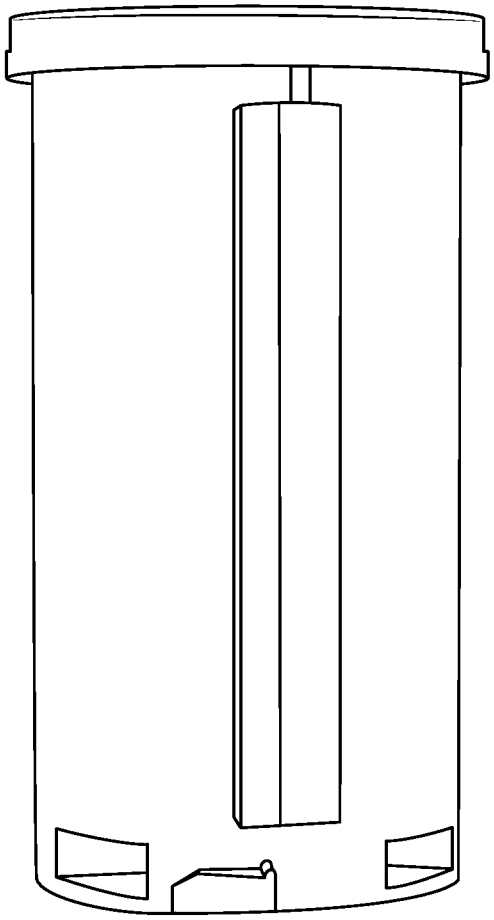
Figure 33:
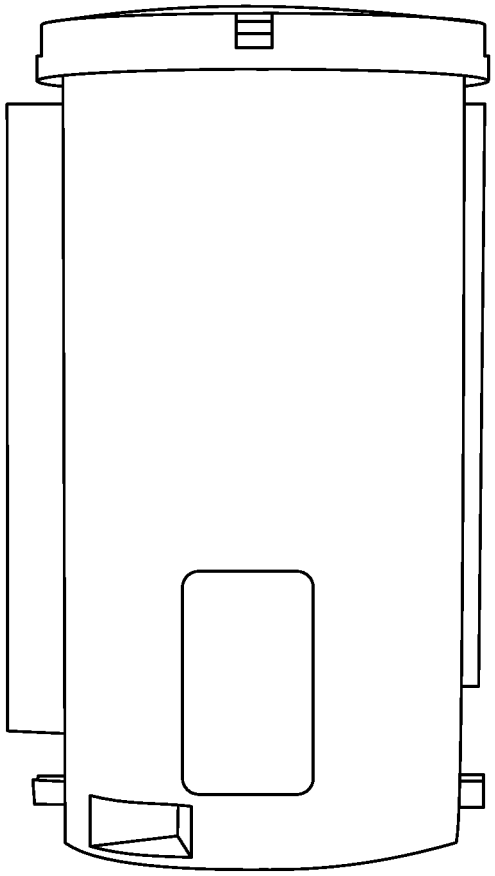
Figure 34:
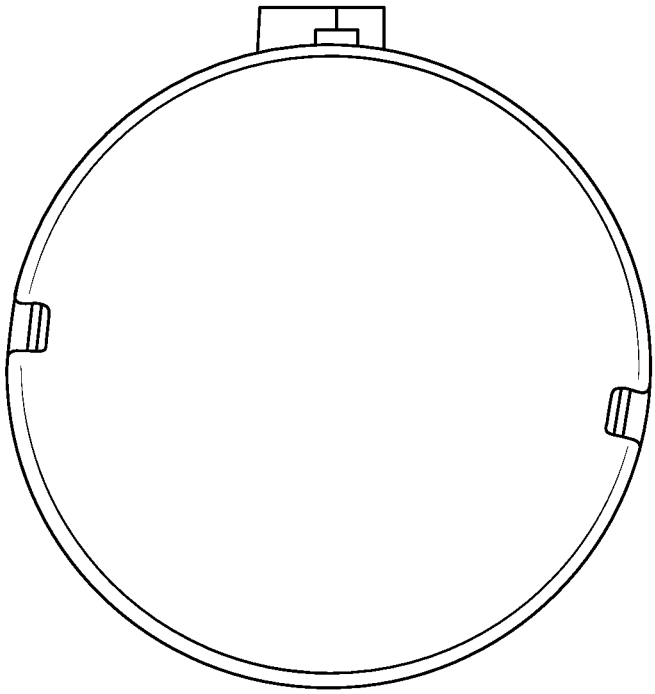
Figure 35:
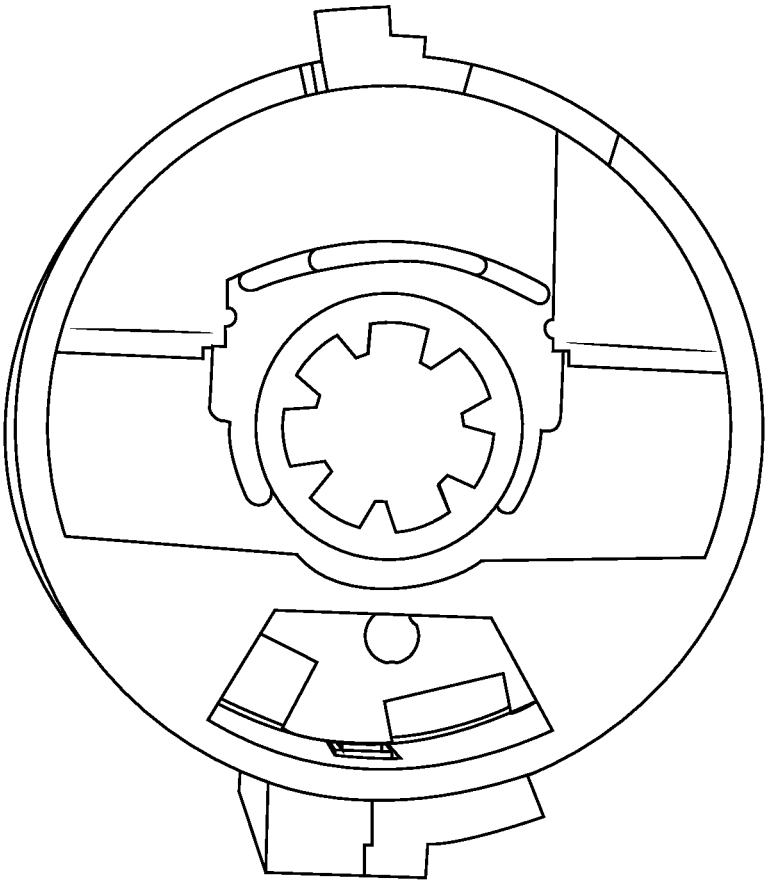
Figure 36:
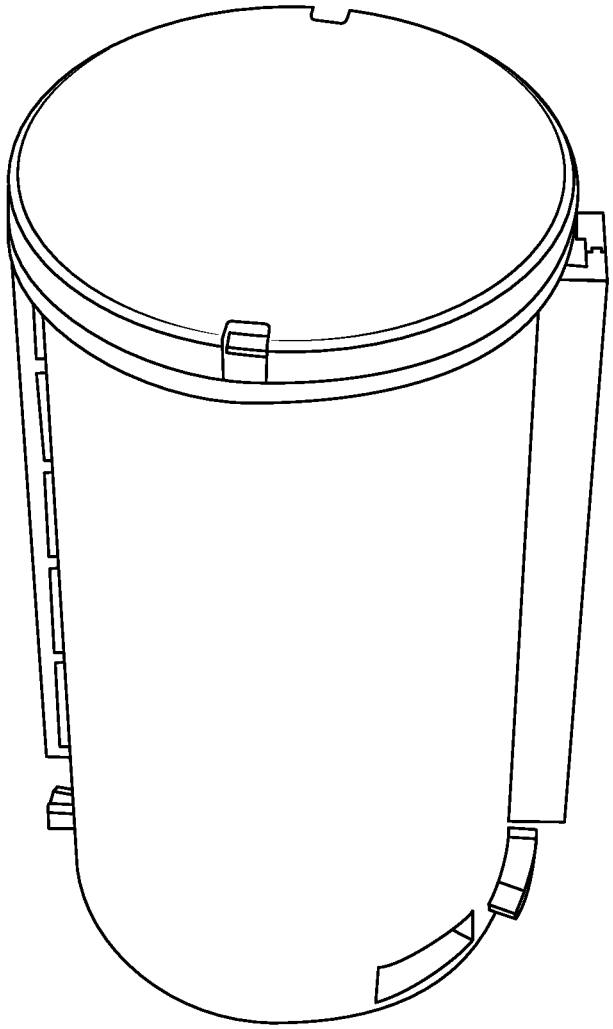
Figure 37:
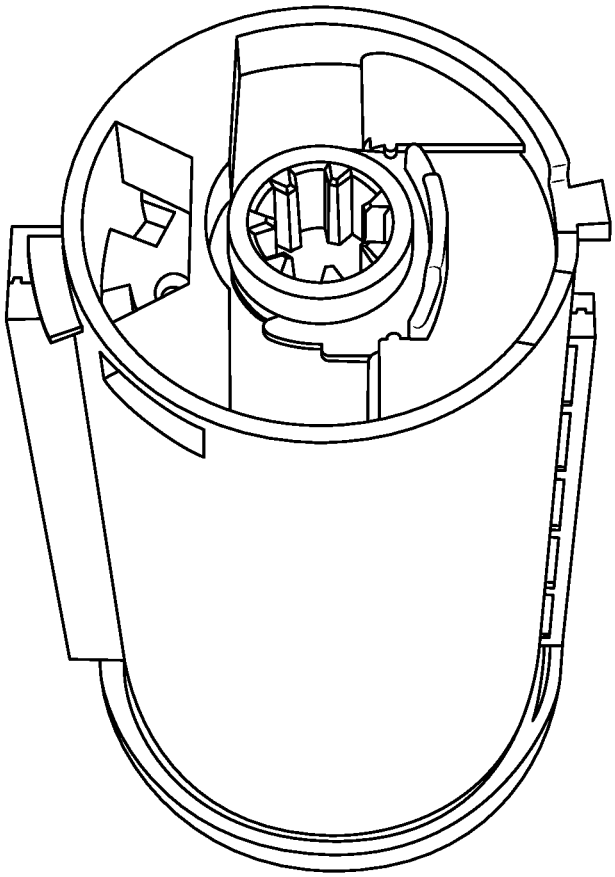

FIGS. 30-37 show several views of a further embodiment of the present invention, a storage compartment with lid. FIG. 30 shows the front of the compartment, while FIG. 31 shows the left side. FIG. 32 illustrates the rear, and FIG. 33 shows the right side of the compartment. FIG. 34 shows the view from the top (the front faces the bottom of the page), and FIG. 35 shows the view from the bottom (the front faces the top of the page). FIG. 36 provides a perspective view of the compartment viewed from the top and left (the compartment is laid on its side). FIG. 37 shows a perspective view of the compartment from the bottom left (again, the compartment is laid on its side).

EXAMPLES

Example 1—Management of a Patient's Regimen

Reference will be made to various components identified in the figures solely to aid comprehension.

An elderly patient, diagnosed with hypertension, hypercholesterolemia, and mild arthritis, has been prescribed four different medications by her physician. A fifth medication, for arthritis pain, is to be taken as needed but not more than four times in a twenty-four hour period. In addition, the patient prefers to take a daily multivitamin with extra calcium for general good health and to ward off osteoporosis. After the pharmacist confirms that no adverse drug interactions are likely, the patient's home health nurse programs the patient's dispensing device (900) to signal with an audible tone when medications are to be taken, and to dispense the medications. The home health nurse sequentially removes each receiver (510) from each storage compartment (912), selects the appropriate receiver (510) for each storage compartment (912) if a differently-sized receiver (510) is needed, and couples the receiver (510) to the appropriate spacer(s) (260) and thickness inserts (250) in each selection slot (220), so that each selection slot has dimensions suitable for separating a single solid dosage form. The sweeper (505) in each storage compartment (912) is adjusted to accommodate the height of the receiver (510) plus any spacer(s) (260, or 561, 562). The home health nurse fills a first storage compartment (912) with the pills of the first medicine, a second storage compartment (912) with the capsules of the second medicine, a third storage compartment (912) with the tablets of the third medicine, a fourth storage compartment (912) with the gel capsules of the fourth medicine, and a fifth storage compartment (912) with the pills of the fifth medication. A sixth storage compartment (912) contains the capsules of the multivitamin.

The next morning, as scheduled, the dispensing device (900) beeps continuously to alert the patient, and a message appears on visual display (955), "TAKE or SKIP?" The patient uses menu navigation buttons (957) and select button (956) to choose the "TAKE" option. Then, a motor rotates the receiver (510) in the first storage compartment (912). Single solid dosage forms (501) are separated by the selection slots (520) with the aid of the sweeper (505) in the first storage compartment (912). One selection slot (520) aligns with exit port (744) and the single solid dosage form drops through the exit port (744) of the first storage compartment (912) into the collection funnel (886), which passes the form to the dispensing ramp (887). As the solid dosage form passes fiberoptic array (834), the form is detected. For the first medicine, two pills are required, so the rotation is repeated and a second pill is dispensed. The rotation, dispensing, and detecting are repeated in the second, third, fourth, and sixth storage compartments (912), until all medicine and the multivitamin to be taken at this time have been dispensed. The dispensing device (900) beeps, a message "Take with food." appears on display (955), and the patient collects the medicine and the multivitamin to consume with breakfast. The patient presses the select button (956) to confirm that she is taking the dispensed medicine, and to stop further beeping from the dispensing device (900).

At lunchtime, the dispensing device (900) beeps, and a message appears on the visual display (955), "TAKE or SKIP?" When the patient selects "TAKE," the receiver (510) in the third storage compartment (912) rotates and dispenses a solid dosage form in the same manner. The dispensing device (900) beeps, and a message appears on display (955), "Take before lunch." The patient collects the medicine and consumes it, and presses the select button (956) to confirm that she has.

In the afternoon, the patient is experiencing arthritis-related pain. She approaches the dispensing device (900) and presses the illuminated PRN button (958). A menu appears on display (955), listing the available PRN (i.e., as-needed) medications.

Using navigation buttons (957) and select button (956), the patient highlights and selects the pain medication option. The receiver (520) in the fifth storage compartment (912) rotates and dispenses a single dosage form of the pain medication. A message appears on display (955) "Take with a full glass of water."

At dinnertime, the dispensing device (900) beeps, and "TAKE or SKIP?" appears on visual display (955). The patient selects "SKIP" using the menu navigation buttons (957) and the select button (956), because she is not feeling well. The event is recorded by device (900) and the next scheduled time is calculated and stored for future notice.

Example 2—Resolving a Jam

Same as in Example 1, but a jam is detected.

When the receiver (510) in the third storage compartment (912) rotates clockwise 90 degrees, the fiberoptic array (834) detects that no solid dosage form has exited the collection funnel (886). Thus, it is determined that the selection slot (520) has not separated the single solid dosage form from the plurality of solid dosage forms stored in the third storage compartment (912). The processor instructs the motor to rotate the receiver (510) counterclockwise 45 degrees. This time, the fiberoptic array (834) detects the presence of the single solid dosage form, which then appears at the dispensing ramp (987) for the patient to collect.

Example 3—Configuring a Storage Compartment

A person desiring to configure a storage compartment for a particular solid dosage form will first determine the dimensions of the solid dosage form. Any suitable tool can be used, such as a ruler, caliper, or specially-designed template for the purpose. For example, if a solid dosage form in capsule form has an arbitrary length "11" and arbitrary diameter "B," the person will select components matching those dimensions. Suitable components can be identified from correlation tables, computer-resident databases, or any suitable means. Optionally, the components will be labelled, making their identification easier. See, for example, thumb tabs (1708*a*, 1708*b*, 1708*c*). A suitable receiver (1610*a*) comprising a selection slot selector (1611*a*) and selection slot carrier (1613*a*) will be chosen or assembled so that the appropriate selection slot (1620*a*1) is revealed by the selection slot selector (1671*a*). Then, one or more suitable spacers (1661*a*, 1661*b*) will be reversibly coupled to the selection slot carrier (1613*a*), an axial shaft (190) will be added, and the assembled components will be placed in the interior of a storage compartment (1812) so the axial shaft (190) and its base (1895) extend through the bottom (1842) of the storage compartment (1812). A shaft clip (1892) held by a frame (1894) will secure the assembled components to the storage compartment (1812) in a manner that allows the axial shaft, receiver, and spacers to rotate about the axis of the axial shaft. Then, a sweeper (1705*b*) such as shown in FIG. 25, will be added to the storage compartment (1812) by sliding sweeper shaft (1709*b*) into sweeper niche (1821) until the sweeper (1705*b*) is properly positioned relative to the receiver. Then, the storage compartment (1812) is ready to receive the capsules and is configured to separate and dispense one capsule at a time.

EMBODIMENTS

Embodiment 1

A device for dispensing a solid dosage form, comprising:
a storage compartment comprising a volume for storing a plurality of solid dosage forms having a same shape; and
a receiver coupled to the storage compartment and adapted to rotate about an axis, comprising a selection slot at a distance from the axis,
wherein the selection slot is adapted to separate a single solid dosage form from the plurality of solid dosage forms when the receiver is selectively rotated clockwise and counterclockwise about the axis, and
wherein the receiver is adapted to reversibly couple to at least one spacer to accommodate the same shape in the selection slot.

Embodiment 2

A device for selectively dispensing two or more unique solid dosage forms from a collection of unique solid dosage forms, wherein a unique solid dosage form in the collection has a shape that is independently alike or different from other unique solid dosage forms in the collection, wherein the device comprises:
a storage compartment for each unique solid dosage form, comprising a volume for storing a plurality of the unique solid dosage form separately from other unique solid dosage forms in the collection, and
a receiver coupled to the storage compartment for each unique solid dosage form, the receiver adapted to rotate about an axis, and composing a selection slot at a distance from the axis,
wherein the selection slot is adapted to separate a single unique solid dosage form from the plurality stored in the storage compartment when the receiver is selectively rotated clockwise and counterclockwise about the axis, and
wherein the receiver is adapted to reversibly couple to at least one spacer to accommodate the shape of the unique solid dosage form in the selection slot.

Embodiment 3

The device of any one of embodiments 1-2, wherein the receiver is adapted to reversibly couple to at least one thickness insert to accommodate the same shape in the selection slot.

Embodiment 4

The device of any one of embodiments 1-3, wherein the receiver is substantially circular.

Embodiment 5

The device of any one of embodiments 1-4, wherein the selection slot is located at an edge of the receiver.

Embodiment 6

The device of any one of embodiments 1-5, wherein the selection slot comprises a guiding portion adapted to introduce the single solid dosage form into the selection slot, and a transporting portion adapted to move the single solid dosage form away from the plurality of solid dosage forms.

Embodiment 7

The device of any one of embodiments 1-6, wherein the selection slot is adapted to reversibly couple to the at least one thickness insert, thereby reducing a dimension of the selection slot.

Embodiment 8

The device of any one of embodiments 1-7, wherein the receiver is adapted to reversibly couple to the at least one spacer in a manner that lengthens a dimension of the selection slot.

Embodiment 9

The device of any one of embodiments 1-8, wherein the receiver further defines a convex surface adapted to direct solid dosage forms from the plurality toward the selection slot.

Embodiment 10

The device of any one of embodiments 1-9, wherein the receiver comprises more than one selection slot.

Embodiment 11

The device of any one of embodiments 1-10, wherein the device further comprises a sweeper coupled to the storage compartment and adjustably positioned proximate to the selection slot of the receiver to aid the selection slot to separate the single solid dosage form when the receiver is selectively rotated.

Embodiment 12

The device of any one of embodiments 1-11, wherein the storage compartment further comprises a desiccant in fluid contact with the plurality of solid dosage forms.

Embodiment 13

The device of any one of embodiments 1-12, wherein the device further comprises a detector to detect when the selection slot has separated a single solid dosage form from the plurality of solid dosage forms.

Embodiment 14

The device of any one of embodiments 1-13, wherein the device further comprises a detector to detect whether a single solid dosage form has been dispensed from the device.

Embodiment 15

The device of any one of embodiments 13-14, wherein the detector comprises an electromechanical switch, a laser diode, a fiberoptic array, a photoanode, or a combination of two or more thereof.

Embodiment 16

A method of making the device of any one of embodiments 1-15, comprising: adapting the receiver to be coupled to the storage compartment.

Embodiment 17

A method of making the device of any one of embodiments 1-16, comprising: coupling the receiver to the storage compartment.

Embodiment 18

A method of dispensing a single solid dosage form, comprising:

(a) obtaining a device that comprises a storage compartment storing a plurality of solid dosage forms having a same shape; and a receiver coupled to the storage compartment and adapted to rotate about an axis, comprising a selection slot at a distance from the axis, wherein the receiver is adapted to reversibly couple to at least one spacer to accommodate the same shape in the selection slot;

(b) rotating in a first direction the receiver about the axis;

(c) determining that the selection slot has not separated the single solid dosage form from the plurality;

(d) rotating in a second direction the receiver about the axis;

(e) optionally repeating one or more of the (b) rotating in a first direction, the (c) determining, and the (d) rotating in a second direction; and (f) detecting that the selection slot has separated the single solid dosage form from the plurality;

(g) dispensing the single solid dosage form from the device; thereby dispensing the single solid dosage form.

Embodiment 19

A method of resolving a jam in a device for dispensing a solid dosage form, wherein the device comprises a storage compartment storing a plurality of solid dosage forms having a same shape; and a receiver coupled to the storage compartment and adapted to rotate about an axis, comprising a selection slot at a distance from the axis, wherein the receiver is adapted to reversibly couple to at least one spacer to accommodate the same shape in the selection slot;

the method comprising:

(a) rotating in a first direction about 90 degrees the receiver;

(b) determining that a jam of the solid dosage forms exist;

(c) rotating in a second direction about 45 degrees the receiver;

(d) detecting that the selection slot has separated a single solid dosage form from the plurality;

thereby resolving the jam.

Embodiment 20

The method of embodiment 19, further comprising, after the (c) rotating in a second direction, (c.1) determining that the jam still exists;

(c.2) repeating for a first predetermined number of attempts the (a) rotating in a first direction, the (b) determining, and the (c) rotating in a second direction.

Embodiment 21

The method of embodiment 20, further comprising, after the (c.2) repeating, (c.3) determining that the jam still exists;

(c.4) rotating in the second direction about 90 degrees the receiver;

(c.5) determining that the jam still exists; and (c.6) rotating in the first direction about 45 degrees the receiver.

Embodiment 22

The method of embodiment 21, further comprising, after the (c.6) rotating in the first direction, (c.7) determining that the jam still exists;

(c.8) repeating for a second predetermined number of attempts the (c.4) rotating in the second direction, the (c.5) determining, and the (c.6) rotating in the first direction.

Embodiment 23

The method of any one of embodiments 18-22, wherein the first direction is clockwise, and the second direction is counterclockwise.

Embodiment 24

The method of any one of embodiments 18-22, wherein the first direction is counterclockwise, and the second direction is clockwise.

Embodiment 25

A method for dispensing two or ore unique solid dosage forms from a collection of unique solid dosage forms, wherein a unique solid dosage form in the collection has a shape that is independently alike or different from other unique solid dosage forms in the collection, wherein the method comprises:

(a) obtaining a device that comprises storage compartments, each storage compartment storing a plurality of a unique solid dosage form separately from other unique solid dosage forms, and comprising a receiver coupled to the storage compartment, adapted to rotate about an axis, comprising a selection slot at a distance from the axis, wherein the receiver is adapted to reversibly couple to at least one spacer to accommodate in the selection slot the shape of the unique solid dosage form stored in the storage compartment;

(b) selecting the two or more unique solid dosage forms from the collection to dispense, thereby identifying selected forms;

(c) for at least one of the storage compartments storing the selected forms, (i) rotating in a first direction the receiver about the axis;

(ii) determining that the selection slot has not separated a single selected form from the plurality;

(iii) rotating in a second direction the receiver about the axis;

(iv) optionally repeating one or more of the (i) rotating in a first direction, the (ii) determining, and the (iii) rotating in a second direction; and (v) detecting that the selection slot has separated the single selected form from the plurality;

(d) for at least one other of the storage compartments storing the selected forms, (i) rotating in a third direction the receiver about the axis, wherein the third direction is independently alike or different from the first direction;

(ii) detecting that the selection slot has separated the single selected form from the plurality;

(e) repeating (c) and (d) until all selected forms have been separated;

(f) dispensing all selected forms that have been separated; thereby dispensing the two or more unique solid dosage forms.

Embodiment 26

The method of embodiment 25, wherein the collection of unique solid dosage forms represents the weekly pharmaceutical and nutraceutical consumption of a patient.

Embodiment 27

The method of any one of embodiments 25-26, wherein the (b) selecting represents a single pharmaceutical and nutraceutical consumption event of a patient.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A storage compartment for storing and dispensing a plurality of solid dosage forms having a same shape; the storage compartment comprising:

a volume for storing the plurality of solid dosage forms;

a receiver coupled to the storage compartment and adapted to rotate about an axis, comprising a selection slot at a distance from the axis, wherein the selection slot is adapted to separate a single solid dosage form from the plurality of solid dosage forms when the receiver is selectively rotated clockwise and counterclockwise about the axis;

a sweeper coupled to the storage compartment and adjustably positioned proximate to the selection slot of the receiver to aid the selection slot to separate the single solid dosage form when the receiver is selectively rotated clockwise and counterclockwise about the axis; and at least two pins for coupling the storage compartment to a dispensing device, the at least two pins having different dimensions to ensure proper orientation of the storage compartment relative to the dispensing device.

2. The storage compartment of claim 1, wherein the receiver comprises a selection slot selector reversibly coupled to a selection slot carrier, wherein the selection slot carrier comprises a plurality of selection slots of different dimensions.

3. The storage compartment of claim 1, wherein the receiver is reversibly coupled to at least one spacer in a manner that lengthens a dimension of the selection slot to accommodate the same shape in the selection slot.

4. The storage compartment of claim 1, wherein the receiver comprises a spacer that lengthens a dimension of the selection slot to accommodate the same shape in the selection slot, and wherein the receiver and the spacer are molded of a single piece of material.

5. The storage compartment of claim 1, further comprising a desiccant in fluid contact with the volume for storing the plurality of solid dosage forms.

6. The storage compartment of claim 1, wherein the receiver is reversibly coupled to at least one thickness insert to accommodate the same shape in the selection slot.

7. The storage compartment of claim 1, wherein the receiver further defines a convex surface adapted to direct solid dosage forms from the plurality toward the selection slot.

8. The storage compartment of claim 1, wherein the receiver comprises more than one selection slot.

9. The storage compartment of claim 1, wherein the selection slot is located at an edge of the receiver.

10. The storage compartment of claim 1, wherein the storage compartment further comprises a lid.

11. The storage compartment of claim 10, wherein the lid comprises a latch and is held to the storage compartment by one or more hinges.

12. The storage compartment of claim 1, wherein the receiver comprises an axial shaft having a base adapted to couple to a motor for selectively rotating the receiver clockwise and counterclockwise about the axis.

* * * * *